US008186987B2

(12) United States Patent
Sumida et al.

(10) Patent No.: US 8,186,987 B2
(45) Date of Patent: May 29, 2012

(54) NANO-FIBER MANUFACTURING APPARATUS

(75) Inventors: Hiroto Sumida, Nara (JP); Takahiro Kurokawa, Tokyo (JP); Kazunori Ishikawa, Osaka (JP); Mitsuhiro Takahashi, Ehime (JP); Mikio Takezawa, Kagawa (JP); Yoshiaki Tominaga, Kanagawa (JP)

(73) Assignee: Panasonic Corporation, Osaka (JP)

( * ) Notice: Subject to any disclaimer, the term of this patent is extended or adjusted under 35 U.S.C. 154(b) by 168 days.

(21) Appl. No.: 12/523,900

(22) PCT Filed: Feb. 19, 2008

(86) PCT No.: PCT/JP2008/000254

§ 371 (c)(1),
(2), (4) Date: Jul. 21, 2009

(87) PCT Pub. No.: WO2008/102538

PCT Pub. Date: Aug. 28, 2008

(65) Prior Publication Data

US 2010/0092687 A1 Apr. 15, 2010

(30) Foreign Application Priority Data

Feb. 21, 2007 (JP) ..... 2007-041314
Nov. 6, 2007 (JP) ..... 2007-288844

(51) Int. Cl.
*D01D 7/02* (2006.01)
*D04H 1/728* (2012.01)

(52) U.S. Cl. ..... 425/73; 425/83.1; 425/174.8 E; 425/382.2; 425/404; 425/445; 425/464

(58) Field of Classification Search ..... 425/73, 425/74, 83.1, 135, 174.8 E, 382.2, 404, 445, 425/464

See application file for complete search history.

(56) References Cited

U.S. PATENT DOCUMENTS 2,168,027 A * 8/1939 Gladding ..... 425/174
2,323,025 A * 6/1943 Formhals ..... 264/10

(Continued)

FOREIGN PATENT DOCUMENTS

JP 59-204957 11/1984

(Continued)

OTHER PUBLICATIONS

Partial English translation of JP 2004-256974, Sep. 2004.

(Continued)

*Primary Examiner* — Yogendra Gupta
*Assistant Examiner* — Joseph Leyson
(74) *Attorney, Agent, or Firm* — Wenderoth, Lind & Ponack, L.L.P.

(57) ABSTRACT

Provided is a nano-fiber manufacturing apparatus which manufactures nano-fibers by an electrostatic explosion, and has a low possibility of explosion even when a flammable solvent is used. The nano-fiber manufacturing apparatus (101) having an ejection unit (110) which ejects solution (200) that is raw material liquid for nano-fibers (200) to a manufacturing space in which the nano-fibers (200) are manufactured by an electrostatic explosion of the solution (200), and a charging unit which charges the solution (200). The nano-fiber manufacturing apparatus (101) includes a gas supply source (103) which supplies safety gas to change an atmosphere of the manufacturing space, in which the solution (200) is ejected, into a low oxygen atmosphere, and a partition (102) which maintains the manufacturing space at a lower oxygen atmosphere than an atmosphere of an outside space of the partition (102).

4 Claims, 17 Drawing Sheets

U.S. PATENT DOCUMENTS

| | | | | |
|---|---|---|---|---|
| 2,810,426 | A * | 10/1957 | Till et al. | 264/438 |
| 5,057,260 | A | 10/1991 | Reinehr et al. | |
| 6,313,228 | B1 | 11/2001 | Huber et al. | |
| 6,616,435 | B2 | 9/2003 | Lee et al. | |
| 2002/0122840 | A1 | 9/2002 | Lee et al. | |
| 2005/0224998 | A1 * | 10/2005 | Andrady et al. | 264/10 |
| 2005/0224999 | A1 * | 10/2005 | Andrady et al. | 264/10 |
| 2006/0135020 | A1 | 6/2006 | Weinberg et al. | |

FOREIGN PATENT DOCUMENTS

| | | |
|---|---|---|
| JP | 2-273566 | 11/1990 |
| JP | 02-293413 | 12/1990 |
| JP | 5-051808 | 3/1993 |
| JP | 2000-169522 | 6/2000 |
| JP | 2002-180365 | 6/2002 |
| JP | 2002-201559 | 7/2002 |
| JP | 2004-256974 | 9/2004 |
| JP | 2005-194675 | 7/2005 |
| JP | 2005-264401 | 9/2005 |
| JP | 2008-524462 | 7/2008 |
| WO | 2006/066025 | 6/2006 |

OTHER PUBLICATIONS

Partial English translation of JP 59-204957, Nov. 1984.

International Search Report issued May 27, 2008 in the International (PCT) Application of which the present application is the U.S. National Stage, PCT/JP2008/000254.

English translation of JP 2004-256974, Sep. 2004.

Partial English Translation for Japanese Patent Application Publication No. 2005-194675, published Jul. 21, 2005.

Full Machine English Translation of Japanese Patent Application Publication No. 2005-194675, published Jul. 21, 2005.

* cited by examiner (a)

(b)

NANO-FIBER MANUFACTURING APPARATUS

TECHNICAL FIELD

The present invention relates to a nano-fiber manufacturing apparatus for manufacturing nano-fibers by an electrostatic explosion, and collecting the nano-fibers, and particularly relates to a nano-fiber manufacturing apparatus for manufacturing nano-fibers from solution as raw material liquid which requires explosion prevention measures.

BACKGROUND ART

Conventionally, electrospinning (electric charge induced spinning) is known as a method for manufacturing filamentous substances (hereinafter referred to as "nano-fibers") made of polymeric substances and having a diameter in a submicron scale.

In the electrospinning method, solution in which polymeric substances are dissolved (dispersed) in solvent is discharged (injected), to a manufacturing space, through a needle nozzle to which a high voltage is applied, so that nano-fibers can be obtained. More specifically, as the solvent of the solution which is charged by a high voltage evaporates, charge density increases. When Coulomb force acting oppositely generated in the solution exceeds the surface tension of the solution, the solution undergoes a phenomenon in which the solution is explosively stretched into filament (electrostatic explosion). The electrostatic explosion is repeated in the manufacturing space, thereby manufacturing nano-fibers made of polymeric substances with a submicron diameter.

A thin film having three dimensional structure of three dimensional mesh can be obtained by depositing nano-fibers manufactured by the above method on a substrate, and a highly porous web (nonwoven fabric) having submicron mesh can be manufactured by forming this film thicker.

Such web manufactured by the electrospinning method has been applied to a filter, a separator for use in a battery, a polymer electrolyte membrane or an electrode for use in a fuel cell, or the like, due to its high porosity made of pores in nano order and high surface area, and expected to achieve high performances.

Conventionally, as a method for manufacturing a practical web made of nano-fibers by manufacturing a large amount of nano-fibers, an apparatus has been proposed which manufactures the web by having a plurality of nozzles arranged in parallel and depositing a large amount of nano-fibers (see Patent Reference 1, for example).

Patent Reference 1: Japanese Unexamined Patent Application Publication No. 2002-201559

SUMMARY OF INVENTION

Problems that Invention is to Solve

However, in the above described nano-fiber manufacturing process, volatile solvent included in the solution stays at a predetermined concentration in the manufacturing space. On the other hand, since a high voltage is applied to the nozzle which ejects the solution, it is difficult to avoid the possibility of electric discharge completely. Thus, when the solvent made of flammable materials is used, a risk of explosion always exists.

Although it is possible to use nonflammable solvent, consideration for environmental issues or the like narrows choices of materials that can be used as solvent and also affects cost.

The present invention is conceived in view of the above problems, and it is an object of the present invention to provide a nano-fiber manufacturing apparatus, which is capable of avoiding risk of explosion and expanding the kinds of selectable solvents in the nano-fiber manufacturing process.

Furthermore, it is another object of the present invention to provide a nano-fiber manufacturing apparatus, which is capable of suppressing increase in cost incurred when performing maintenance work on the nano-fiber manufacturing apparatus.

Means to Solve the Problems

In order to achieve the above objects, a nano-fiber manufacturing apparatus according to the present invention has an ejection unit that ejects solution which is a raw material liquid for a nano-fiber, to a manufacturing space in which the nano-fiber is manufactured by an electrostatic explosion of the solution, and a charging unit that charges the solution, and the nano-fiber manufacturing apparatus includes: a gas supply source that supplies a safety gas to change an atmosphere of the manufacturing space, in which the solution is ejected, into a low oxygen atmosphere; and a partition that maintains the manufacturing space at a lower oxygen atmosphere than an atmosphere of an outside space of the partition.

With this, the atmosphere of the manufacturing space can be maintained at low oxygen atmosphere; therefore it becomes possible to avoid risk of explosion as much as possible even when flammable solvent exists in the manufacturing space.

Furthermore, the gas supply source may supply, to the manufacturing space, a gas having a higher nitrogen concentration than the outside space of the partition.

By introducing gas having a high nitrogen concentration, oxygen concentration in the manufacturing space can be relatively decreased. Furthermore, since nitrogen gas is inert and easily available, it becomes possible to form an atmosphere having a low oxygen concentration in the manufacturing space easily. The gas having a high nitrogen concentration can be any gas as long as nitrogen concentration is higher than the air, and may also be gas having a nitrogen concentration of nearly 100%.

Furthermore, the gas supply source may supply a superheated steam to the manufacturing space.

By introducing superheated steam as a gas supplied to the inside space of the partition, the superheated steam can easily heat the ejected solution by radiative heat transfer, convection heat transfer and condensation heat transfer. Therefore, an electrostatic explosion can be easily generated even when a hard volatile solvent is used as solvent for the solution. As a result, it becomes possible to expand the kinds of selectable solvents such as nonflammable but hard volatile solvents, and consider explosion prevention when selecting solvents. In addition, since superheated steam has a low oxygen concentration, it becomes possible to change an atmosphere of the manufacturing space into a low oxygen condition, and explosions can thus be prevented.

Here, explosion indicates an explosion caused by the solvent in the solution which evaporates and stays in the manufacturing space, and catches fire for some reason (electric discharge, for example). Furthermore, explosion prevention indicates making a condition in which the explosion does not occur. Furthermore, the explosion here is different from the electrostatic explosion which is necessary for manufacturing nano-fibers.

Furthermore, the nano-fiber manufacturing apparatus may further include: a gas supply volume change unit which changes a volume of the gas supplied from the gas supply source to the manufacturing space; a gas composition measuring unit which measures a gas composition in the manufacturing space; and a control unit which controls, based on a signal supplied from the gas composition measuring unit, the gas supply volume change unit so as to maintain the low oxygen atmosphere in the manufacturing space.

Furthermore, the nano-fiber manufacturing apparatus may further include: a gas supply volume change unit which changes a volume of the gas supplied from the gas supply source to the manufacturing space; a pressure measuring unit which measures a pressure in the manufacturing space; and a control unit which controls, based on a signal supplied from the pressure measuring unit, the gas supply volume change unit so as to maintain the pressure in the manufacturing space at a positive pressure.

Furthermore, the nano-fiber manufacturing apparatus may further include: a gas temperature change unit which changes a temperature of the gas supplied from the gas supply source; a temperature measuring unit which measures a temperature in the manufacturing space; and a control unit which controls, based on a signal supplied from the temperature measuring unit, the gas temperature change unit so as to maintain the manufacturing space at a predetermined temperature.

By controlling the atmosphere of the manufacturing space such that it remains constant as described above, high quality nano-fibers can be manufactured.

Furthermore, the nano-fiber manufacturing apparatus may further include an exhaust unit which exhausts a gas which forms the atmosphere of the manufacturing space.

By exhausting the manufacturing space as described above, the atmosphere in the manufacturing space can be introduced to a predetermined place. As a result, consideration of the environment in which the nano-fiber manufacturing apparatus is placed becomes possible. In particular, it is useful to control the atmosphere of the inside space of the partition when the manufacturing space is sealed by the partition. In other words, after considering the ejection volume of the solution for manufacturing nano-fibers, it becomes possible to maintain a constant atmosphere of the manufacturing space sealed by the partition, by balancing the gas supply volume of the gas supply source and the exhaust volume of the atmosphere of the exhaust unit.

Furthermore, it is preferable that the nano-fiber manufacturing apparatus further includes: a collecting unit which collects a manufactured nano-fiber; a first working chamber having the manufacturing space inside and formed with the partition, the first working chamber being capable of keeping a safety gas inside; a second working chamber connected to the first working chamber and formed with the partition, the second working chamber being capable of housing one of the ejection unit and the collecting unit; a first gate being capable of opening and closing between the first working chamber and the second working chamber; and a first door being capable of opening and closing between the second working chamber and an outside of the second working chamber.

With this, the ejection unit or the collecting unit is housed in the second working chamber, and it becomes possible to access the ejection unit or the collecting unit housed in the second working chamber from the outside of the chamber and perform maintenance work, while maintaining the safety gas held in the first working chamber. In addition, purging the first working chamber becomes unnecessary, which contributes to saving the time necessary for purging and decreasing the cost for maintenance.

Furthermore, the nano-fiber manufacturing apparatus may further include: a third working chamber connected to the first working chamber and formed with the partition, the third working chamber being capable of housing the other one of the ejection unit and the collecting unit which is not housed in the second working chamber; a second gate being capable of opening and closing between the first working chamber and the third working chamber; and a second door being capable of opening and closing between the third working chamber and an outside of the third working chamber.

With this, it becomes possible to perform maintenance work both on the ejection unit and the collecting unit while maintaining the first working chamber at a closed condition.

It is preferable that the nano-fiber manufacturing apparatus includes a slide unit which allows the ejection unit to move between the first working chamber and the second working chamber or between the first working chamber and the third working chamber.

By providing the slide unit, the ejection unit can be easily housed in the second working chamber or the third working chamber, and also the distance between the collecting unit and the ejection unit can be changed when manufacturing nano-fibers.

Furthermore, the effects and advantages similar to the above can also be obtained by a nonwoven fabric manufacturing apparatus having an ejection unit that ejects solution which is a raw material liquid for a nano-fiber, to a manufacturing space in which the nano-fiber is manufactured by an electrostatic explosion of the solution, a charging unit that charges the solution, and a collecting unit that collects the manufactured nano-fiber, and the nonwoven fabric manufacturing apparatus includes: a gas supply source that supplies a safety gas to change an atmosphere of the manufacturing space, in which the solution is ejected, into a low oxygen atmosphere; a partition which maintains the manufacturing space at a lower oxygen atmosphere than an atmosphere of an outside space of the partition; and a compression unit configured to compress the nano-fiber deposited on the collecting unit.

The objects described above can also be achieved by a nano-fiber manufacturing method which includes: ejecting solution which is a raw material liquid for a nano-fiber, to a manufacturing space in which the nano-fiber is manufactured by an electrostatic explosion of the solution; charging the solution; supplying a safety gas to change an atmosphere of the manufacturing space into a low oxygen atmosphere; and manufacturing the nano-fiber at the low oxygen atmosphere.

With this, the effects and advantages similar to the above described apparatus can be obtained.

Effects of the Invention

According to the present invention, nano-fibers can be manufactured safely. Furthermore, the ejection unit and the collecting unit in the atmosphere of the safety gas or evaporated solvent can be accessed quickly and easily, and maintenance work can be performed.

NUMERICAL REFERENCES

Figure 1:
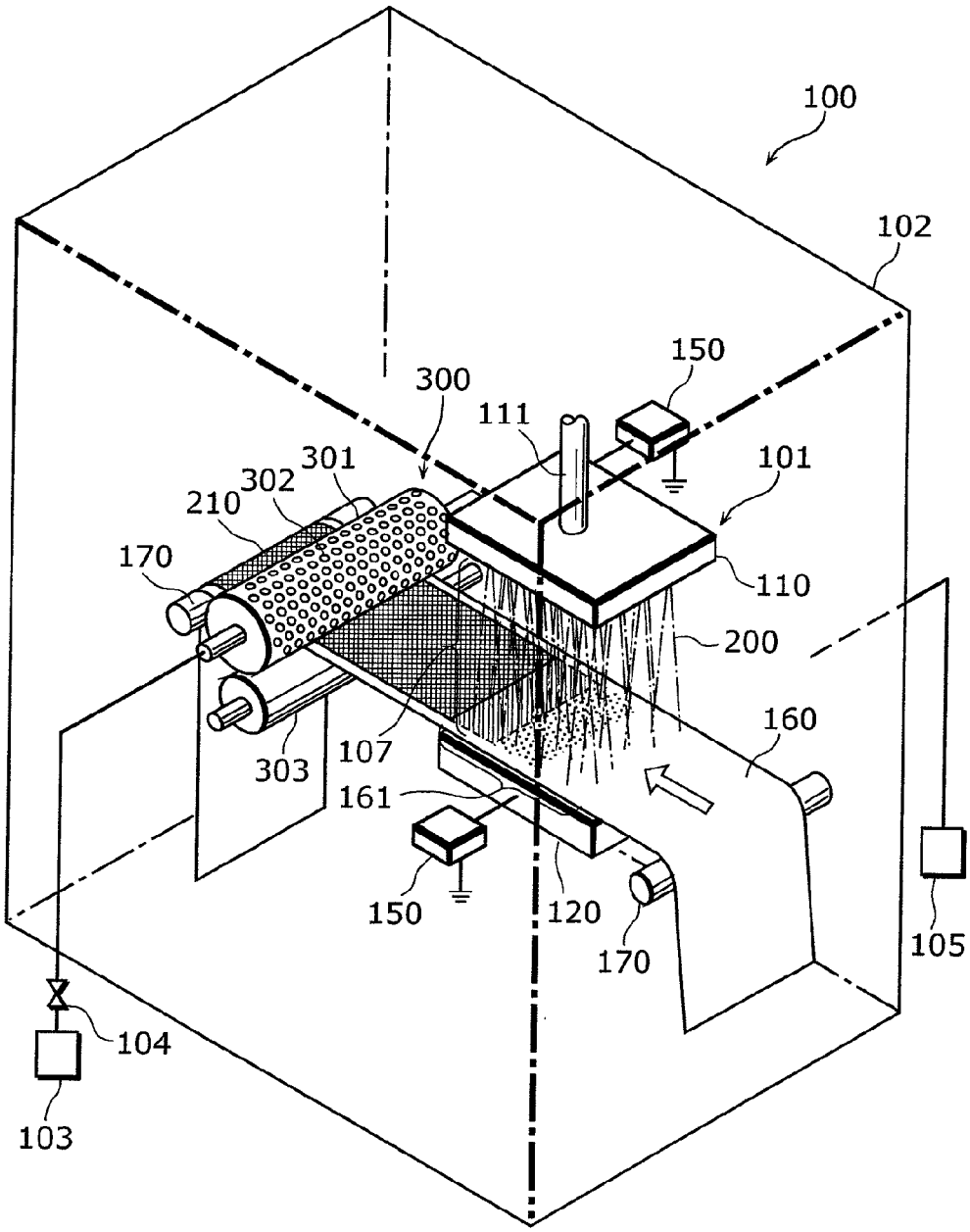
FIG. 1 is a perspective view schematically showing a nonwoven fabric manufacturing apparatus which includes a nano-fiber manufacturing apparatus according to the present invention.

100 Nonwoven fabric manufacturing apparatus
101 Nano-fiber manufacturing apparatus
102 Partition
103 Gas supply source
104 Gas supply volume change unit
105 Exhaust apparatus
106 Exhaust fan
107 Manufacturing space
108 First door
109 Slide unit
110 Ejection unit
111 Pipe
112 Ejection hole
113 Nozzle
114 Barrel
115 Air flow controlling fin
116 Fan
117 Switching valve
119 Collecting unit
120 Collecting electrode
121 Electrode
130 Insulator
131 First working chamber
132 Second working chamber
133 First gate
135 Rail
136 Drive apparatus
137 Mounting portion
150 Power source
151 Voltage change unit
157 Drive unit
158 Moving shaft
159 Insulating plate
160 Sheet
161 Deposition area
162 Supply roll
163 Winding roll
167 Drive unit
170 Moving unit
191 Gas composition sensor
192 Temperature sensor
193 Pressure sensor
200 Solution as raw material liquid/Nano-fiber
203 Third working chamber
206 Second gate
208 Second door
210 Nonwoven fabric
300 Compression unit
301 Compression roller
302 Spraying hole
303 Pinch roller
305 Pressure unit
306 Drive unit
307 Gear
308 Gear
309 Shaft
310 Bearing
311 Cylinder
312 Moving shaft
350 Superheated steam
360 AC power source
400 Operation unit
401 Main control unit
402 Exhaust volume control unit
403 Temperature control unit
404 Supply volume control unit
411 Composition signal acquisition unit
412 Temperature signal acquisition unit
413 Pressure signal acquisition unit
420 Voltage control unit

DETAILED DESCRIPTION OF THE INVENTION

Next, embodiments of the nano-fiber manufacturing apparatus and the nonwoven fabric manufacturing apparatus according to the present invention shall be described.

Embodiment 1

FIG. 1 is a perspective view schematically showing a nonwoven fabric manufacturing apparatus according to the present invention.

As shown in the figure, a nonwoven fabric manufacturing apparatus 100 includes a nano-fiber manufacturing apparatus 101, a partition 102, a gas supply source 103, an exhaust apparatus 105 as an exhaust unit, and a compression unit 300. Since it is difficult to clearly distinguish nano-fibers being manufactured and the solution as raw material liquid, the reference numeral 200 is assigned to both of them, and the reference numeral 210 is assigned to the manufactured nonwoven fabric.

Nano-fibers 200 can be selected from petroleum polymer materials such as polyvinylidene fluoride (FVDF), polyvinylidene fluoride-co-hexafluoropropylene, and polyacrylonitrile, or also copolymer and mixture of these. Depending on the desired quality or capability of the final manufacture, selection among the above materials or the combination can be arbitrarily made.

In addition, examples of solvents include acetone and DMF (N,N-dimethylformamide).

It should be noted that the kinds of materials and solvents for nano-fibers described above are examples. In particular, a variety of solvents can be selected depending on the kinds of introduced gas or atmosphere temperature as shall be described later.

A partition 102 is made of a nonporous member which covers the nonwoven fabric manufacturing apparatus 100 almost entirely. Examples include a boxing assembled with resinous panels or a metallic frame with a flexible and nonporous sheet stretched. The floor on which the nonwoven fabric manufacturing apparatus 100 is placed may be used as the partition 102.

The inside space enclosed by the partition 102 includes a manufacturing space 107 where nano-fibers are manufactured, and the inside space is not air-tightly separated from the outside space of the partition 102.

The gas supply source 103 is an apparatus which supplies gas to the inside space enclosed by the partition 102. Examples of gas supplied from the gas supply source 103 include low oxygen concentration gas in which a certain amount of oxygen is removed from air by using a resin film (hollow fiber membrane), and superheated steam. Here, low oxygen concentration indicates lower concentration than oxygen concentration in the manufacturing space 107 when manufacturing nano-fibers is performed in the atmosphere near the normal surface of the ground without enclosing with the partition 102 and supplying gas. The description here does not exclude the use of high purity gas which hardly contains oxygen, but, for example, high purity nitrogen sealed in a cylinder in the form of liquid or gas, or carbon dioxide supplied from dry ice may also be used.

Hereinafter, the embodiment will be explained in the case of using superheated steam as a safety gas.

The exhaust apparatus 105 is an apparatus that is capable of exhausting the atmosphere that exists in the inside space of the partition 102. For this embodiment, a recovery apparatus which is capable of recovering solvent or the like contained in the exhausted atmosphere is mounted to the exhaust apparatus 105.

The balance between the gas supply volume of the gas supply source 103 and the gas exhaust volume of the exhaust apparatus 105 allows maintaining the inside space of the partition 102 at a positive pressure. Here, positive pressure indicates the state in which the pressure of the inside space is higher than the pressure of the outside space of the partition.

The nano-fiber manufacturing apparatus 101 includes an ejection unit 110 and a collecting electrode 120.

The ejection unit 110 is an apparatus which ejects (discharges) solution for manufacturing nano-fibers, and is connected to a power source 150 in order to charge the solution so that a predetermined electric potential can be maintained. A pipe 111 connected to a tank storing the solution (not shown) is connected to the ejection unit 110 so that the solution can be supplied at a predetermined pressure.

Thus, the power source 150, the ejection unit 110 and the collecting electrode 120 serve as a charging unit which charges the solution.

Figure 2:
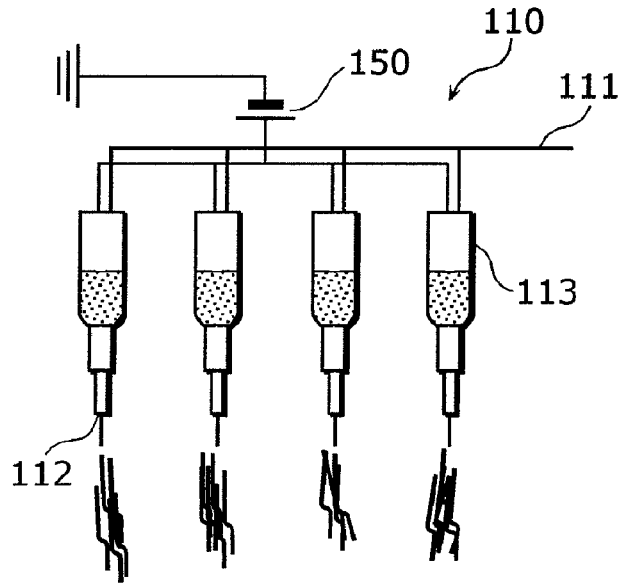
FIG. 2(*a*) shows a specific example of an ejection unit having a plurality of nozzles, and FIG. 2(*b*) shows another specific example of an ejection unit having a cylindrical barrel provided with a plurality of ejection holes.
Figure 2:
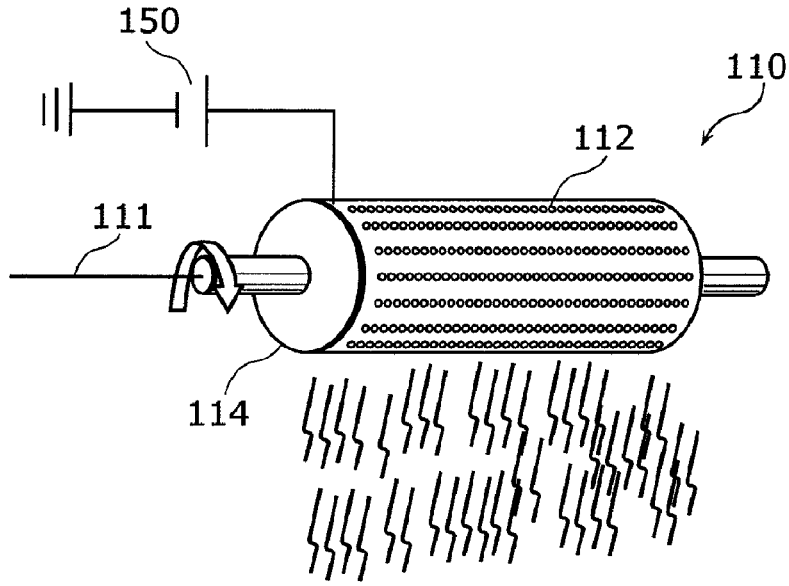

FIG. 2 shows specific examples of the ejection unit.

The ejection unit 110 shown in FIG. 2(*a*) includes a plurality of nozzles 113 each having an ejection hole 112 at the tip, and each nozzle 113 is connected to the power source 150. Each nozzle 113 is connected to the pipe 111 respectively, and the solution is supplied from the tank storing the solution at a predetermined pressure.

The ejection unit 110 shown in FIG. 2(*a*) ejects the solution 200 from the ejection hole 112 with the supplied pressure, and the power source 150 connected to the nozzle 113 charges the ejected solution 200.

The ejection unit 110 shown in FIG. 2(*b*) includes a cylindrical barrel 114 provided with a plurality of ejection holes 112 around the peripheral wall. The barrel 114 is rotatable, and is also maintained at a predetermined electric potential by the power source 150. One end of the shaft provided on the rotating shaft is connected to the pipe 111 so that the solution 200 can be supplied into the inside of the barrel 114.

The ejection unit 110 shown in FIG. 2(*b*) ejects the solution 200 from the ejection hole 112 by centrifugal force, and the power source 150 connected to the barrel 114 charges the ejected solution 200.

In FIG. 1, a sheet 160 is a member serving as a collecting unit, and is a member on which the nano-fibers 200 manufactured in the manufacturing space are deposited. The sheet 160 is a long sheet which is thin and flexible, and made of materials easily separable from the deposited nano-fibers 200.

The sheet 160 is supplied being wound into a roll, and slowly moves the deposition area of the nano-fibers 200 toward the direction of the arrow shown in the figure by a moving unit 170. Then, the sheet 160 is wound into a roll again together with the nonwoven fabric 210 manufactured on the sheet 160. The supply roll which has the sheet 160 wound around (not shown) and the roll which is wound together with the nonwoven fabric 210 around (not shown) are both housed in the inside space of the partition 102.

The moving unit 170 is an apparatus which is capable of sending the sheet 160 in one direction by the rotation of the roller shown in the figure, which is driven by a motor (not shown) or the like, while maintaining a predetermined tension of the sheet 160.

The collecting electrode 120 is a metal electrode to which the electric potential is given by the power source 150 so that a predetermined electric potential difference between the ejection unit 110 and the collecting electrode 120 is generated. The collecting electrode 120 is placed on the opposite side of the ejection unit 110 with respect to the sheet 160 so as to oppose the ejection unit 110. The collecting electrode 120 serves to electrically attract the charged nano-fibers 200 manufactured through the ejection from the ejection unit 110, and allow depositing the nano-fibers 200 on the sheet 160.

For the collecting electrode 120, there are various aspects for evenly distributing the density of the deposited nano-fibers. Hereinafter, each aspect of the collecting electrode 120 shall be described.

(Collecting Electrode <1>)

Figure 3:
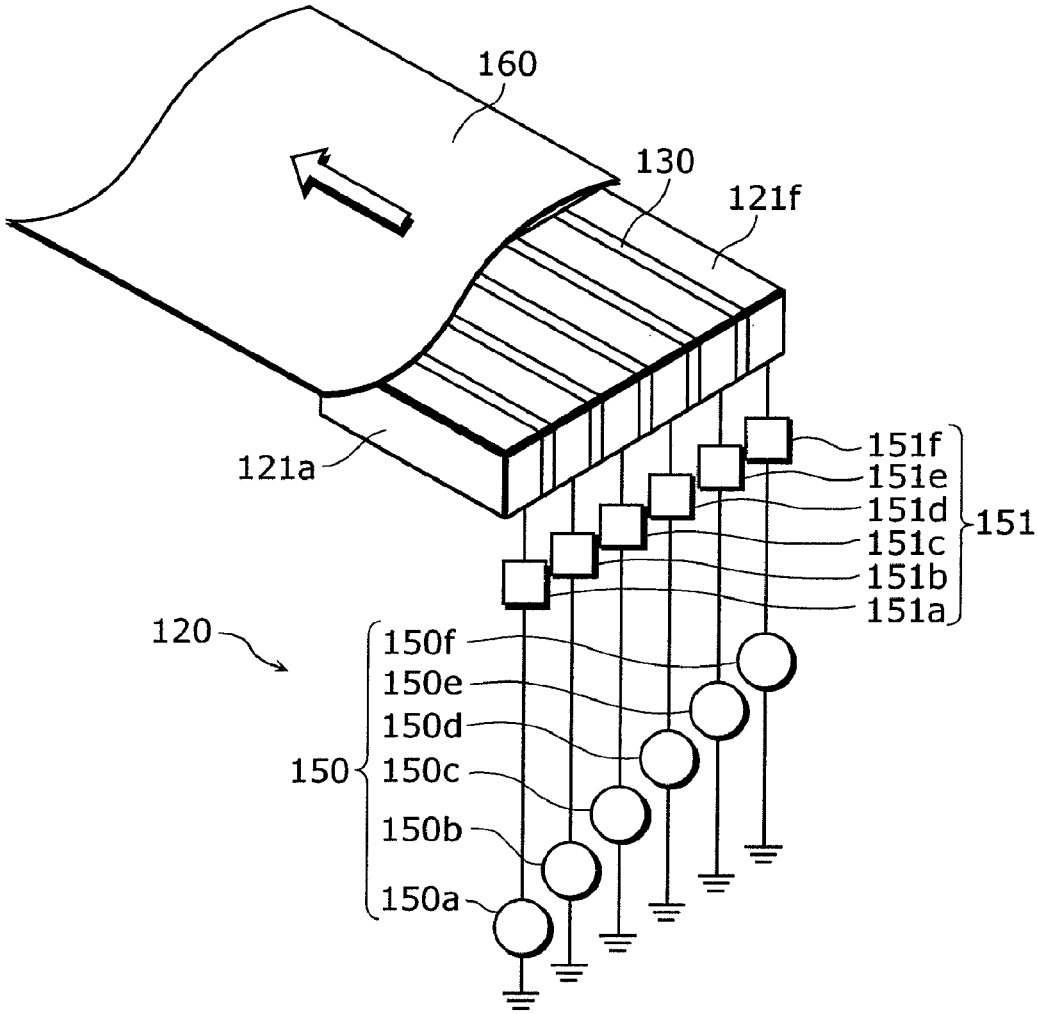
FIG. 3 is a perspective view schematically showing a collecting electrode <1>.

FIG. 3 is a perspective view schematically showing the collecting electrode <1>.

As shown in the figure, the collecting electrode 120 includes a plurality of electrodes 121, the power sources 150 which give the electric potential to each of the plurality of electrodes 121, a voltage change unit 151 which is capable of periodically changing the voltage applied to the electrodes 121, and an insulator 130.

The electrode 121 is a metal member which extends into the moving direction of the sheet 160 (arrow shown in the figure), and placed across the deposition area 161 where the nano-fibers 200 are deposited. In the case of the collecting electrode <1-3>, six electrodes 121 are placed vertically toward the moving direction of the sheet 160, and the insulators 130 are provided between the electrodes. When it is necessary to distinctly indicate each of the electrodes 121 in the description, "a" to "f" shall be used in addition to the numerical reference.

The power source 150 is an apparatus which is capable of giving the electric potential ranging from −50 kV to −100 kV at most. In the case of the collecting electrode <1-3>, the power source 150*a* to the power source 150*f* are connected to the electrode 121*a* to the electrode 121*f* respectively, so that the electric potential can be given to the respective electrodes 121 independently.

The voltage change unit 151 is an apparatus which is capable of changing the electric potential given to the electrode 121 in the approximate range from 10 kV to 100 kV.

According to the structure of the collecting electrode 120 described above, the voltage change unit 151 changes the electric potential of each of the electrodes 121 so that the distribution of the electric field generated on the sheet 160 can be arbitrarily changed. Therefore, it is possible to move the collecting position where the charged nano-fibers 200 are concentrated according to the electric field distribution, which results in improving the uniform thickness of the deposited nano-fibers 200.

(Collecting Electrode <2>)

Next, another collecting electrode 120 shall be described.

Figure 4:
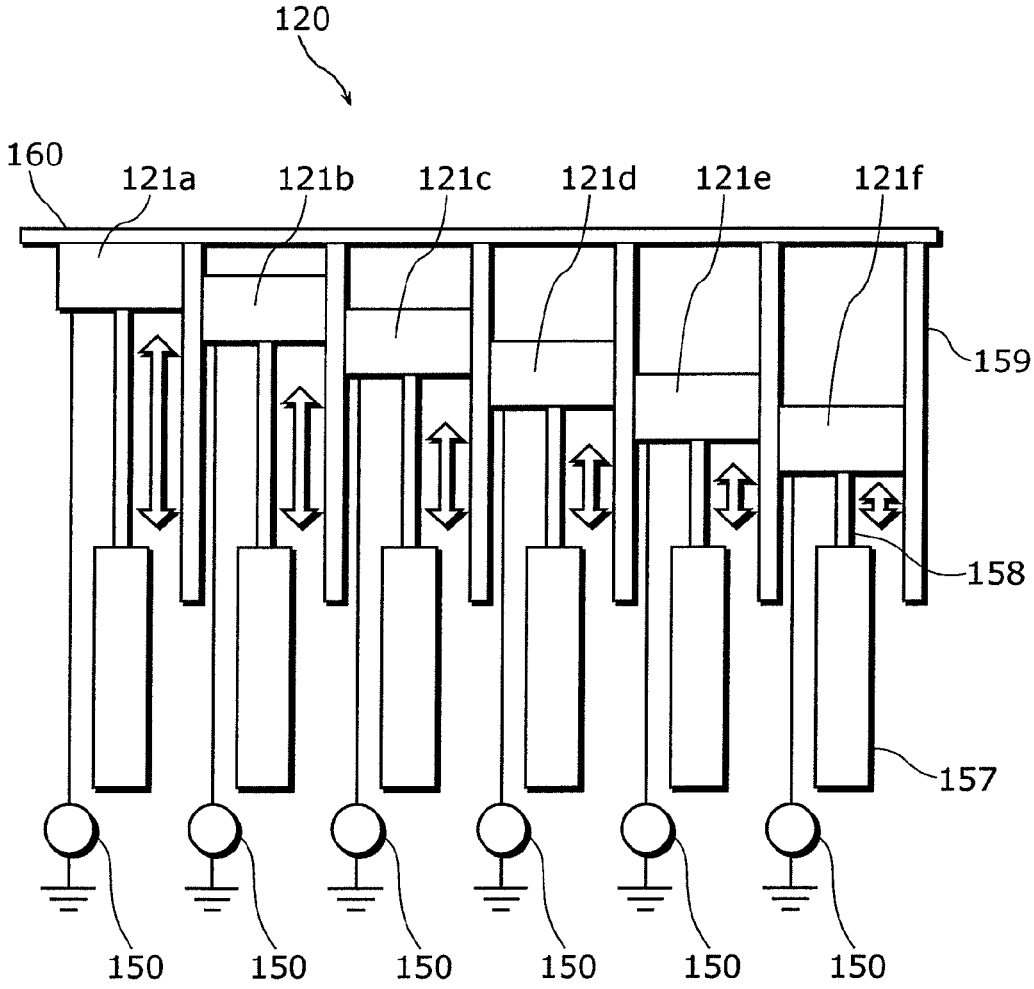
FIG. 4 is a lateral view schematically showing a collecting electrode <2>.

FIG. 4 is a lateral view schematically showing another collecting electrode <2>.

As shown in the figure, the collecting electrode 120 includes a plurality of electrodes 121, the power sources 150 which give the electric potential to each of the plurality of electrodes 121, the drive units 157 which drive the electrodes 121 and the insulating plates 159.

The electrodes 121 and the power sources 150 are same as in the collecting electrode <1-3>, thus the descriptions of them are omitted.

The drive units 157 are capable of reciprocating the respective electrodes 121 independently and linearly, and include moving shafts 158 which appear linearly by pneumatics. The drive units 157 can be any type of linear actuator, and any driving methods can be used such as the method using pneumatics, hydraulic, ball screw, and linear motor. The drive unit 157 moves each of the electrodes 121 along the line connecting the electrode 121 and the ejection unit 110.

The insulating plate 159 serves to regulate shaking caused when the electrode 121 moves, and also to prevent abnormal electric discharge from being generated by blocking the contact or vicinity between each of the electrodes 121.

For such collecting electrode 120 as described above, a constant voltage can be output from the power source 150. Furthermore, control of the movement of each electrode 121 allows to form an electric field which makes continuous changes over time with respect to the deposition area 161 of the sheet 160, which is divided into a direction vertical to the moving direction of the sheet 160.

(Collecting Electrode <3>)

Next, another collecting electrode 120 shall be described.

Figure 5:
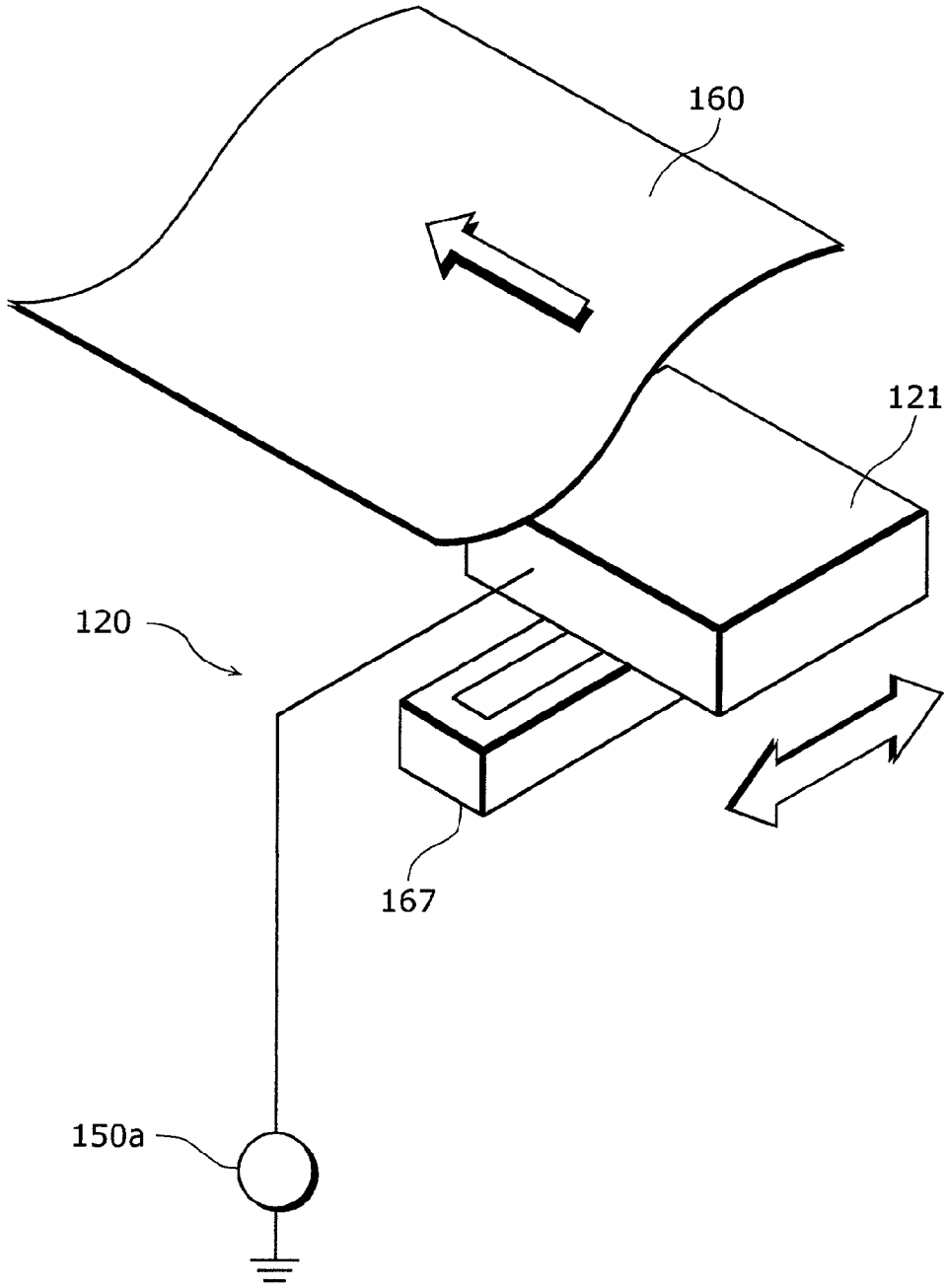
FIG. 5 is a perspective view schematically showing a collecting electrode <3>.

FIG. 5 is a perspective view schematically showing another collecting electrode <3>.

As shown in the figure, the collecting electrode 120 includes the electrode 121, the power source 150 which gives the electric potential to the electrode 121 and a drive unit 167 which drives the electrode 121.

The power source 150 is same as in the collecting electrode <1-3>, thus the description is omitted.

The drive unit 167 is capable of reciprocating the electrode 121 linearly along the rail. The drive unit 167 can be any type of linear actuator as described above, and any driving methods can be used such as the method using pneumatics, hydraulic, ball screw, and linear motor. The drive unit 167 moves the electrode 121 along the width direction of the sheet 160 that is along the line vertical to the moving direction of the sheet 160.

For such collecting electrode 120 as described above, a constant voltage can be output from the power source 150. Furthermore, control of the movement of the electrode 121 allows to form, on the deposition area 161 of the sheet 160, an electric field which changes into a direction vertical to the moving direction of the sheet 160.

When the electric field is changed by the collecting electrode 120 as in this embodiment, the possibility of electric discharge from the sliding portion of each electrode 121 increases, and therefore measures to prevent explosions become necessary especially in the manufacturing space 107. Thus, it can be said that it is a preferable aspect to change an atmosphere of the manufacturing space 107 at a low oxygen condition.

Figure 6:
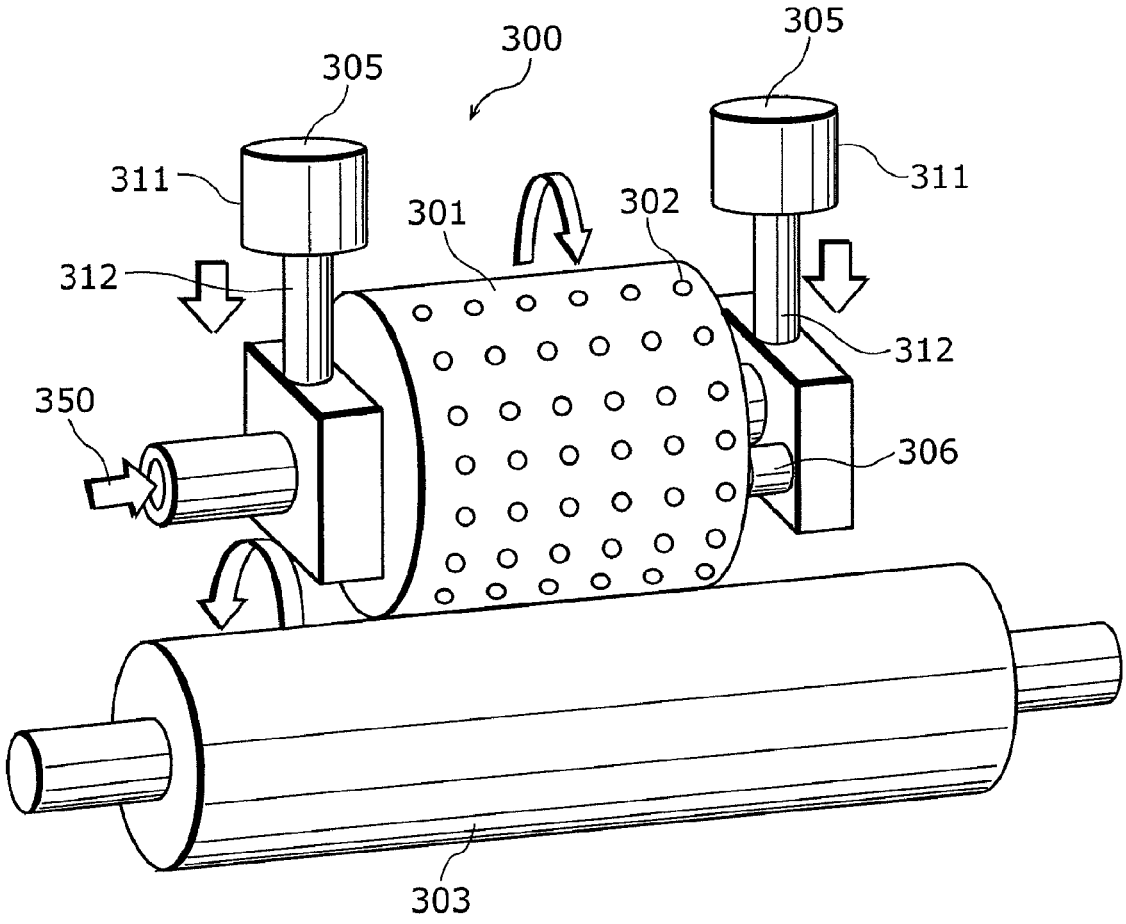
FIG. 6 is a perspective view showing a compression unit.

FIG. 6 is a perspective view showing the compression unit.

Figure 7:
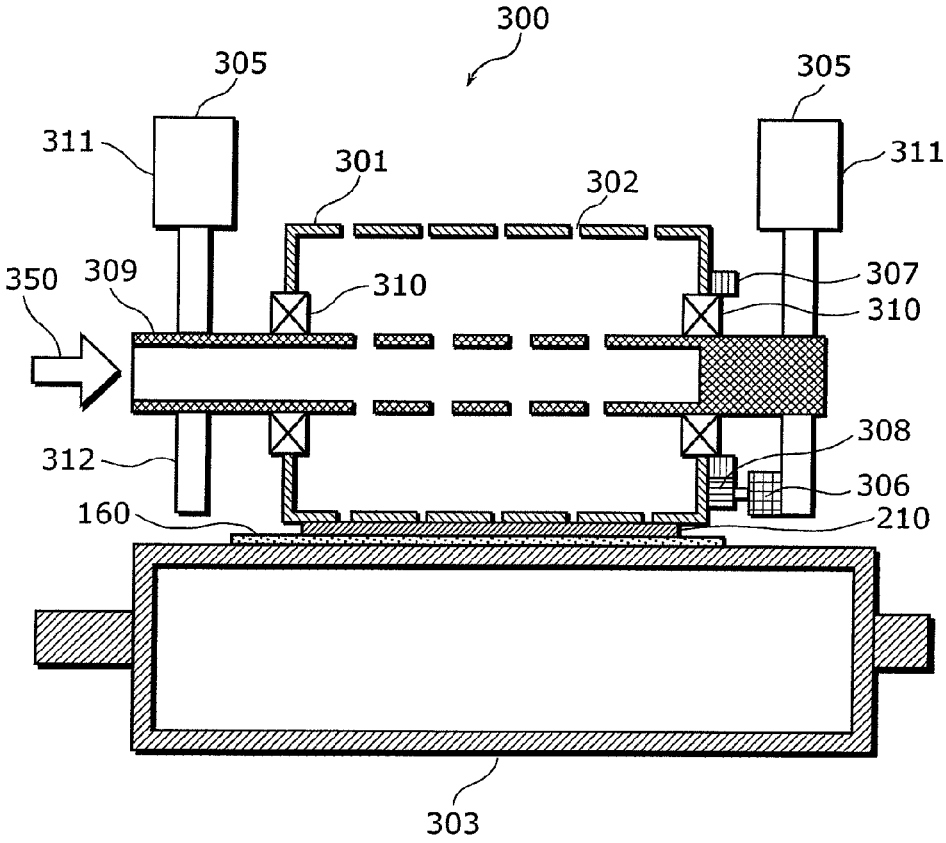
FIG. 7 is a cross-sectional view showing the compression unit.

FIG. 7 is a cross-sectional view showing the compression unit.

As in the figure, the compression unit 300 compresses the nonwoven fabric 210 made of the deposited nano-fibers 200. The compression unit 300 is an apparatus which is capable of spraying superheated steam 350 supplied from the gas supply source 103 to the nonwoven fabric 210 (the nano-fibers 200) while supplying superheated steam 350 to the inside space of the partition 102. The compression unit 300 includes a compression roller 301, a pinch roller 303, pressure units 305, a drive unit 306, gears 307 and 308, and a shaft 309.

The compression roller 301 is a cylindrical tube which continuously presses the nonwoven fabric 210 which moves together with the sheet 160, and includes spraying holes 302 drilled radially around the peripheral wall of the tube.

The shaft 309 is a cylindrical member having a closed end, and is placed co-axially with the rotating shaft of the compression roller 301 so as to penetrate the compression roller 301. The peripheral wall of the shaft 309 includes a plurality of holes drilled radially around so that superheated steam 350 can be discharged as in the compression roller 301.

The shaft 309 and the compression roller 301 are connected via bearings 310 mounted on both ends of the compression roller 301, so that the compression roller 301 is rotatably supported in such a manner that the shaft 309 is fixed.

The pinch roller 303 is a roller which co-operates the compression roller 301 so as to sandwich the nonwoven fabric 210 and the sheet 160, and is rotatably supported according to the movement of the sheet 160.

The gas supply source 103 is connected to the open end of the shaft 309 via a flexible pipe, and introduces the superheated steam generated in the gas supply source 103 into the shaft 309 so that the superheated steam is introduced, via the holes drilled around the shaft 309, to the compression roller 301 having a diameter larger than the shaft 309.

According to this structure, the pipe can be connected easily to the non-rotatable shaft 309 and the superheated steam can be introduced into the compression roller 301. In addition, by introducing the superheated steam into the compression roller 301 via the end of the shaft 309 first, it becomes possible to evenly discharge, from the compression roller 301, the superheated steam to the nonwoven fabric 210 and the inside space of the partition 102.

The pressure unit 305 is an apparatus which presses the compression roller 301 against the pinch roller 303 by air pressure, and includes cylinders 311 and moving shafts 312. The moving shafts 312 are connected to both ends of the shaft 309, and press the compression roller 301 rotatably via the shaft 309 by projecting the moving shafts 312 from the cylinders 311 by air pressure.

Thus, the nonwoven fabric 210 sandwiched between the compression roller 301 and the pinch roller 303 is compressed by the force generated by the air pressure of the pressure unit 305.

The drive unit 306 is an apparatus which forcibly rotates the compression roller 301, and includes a stepping motor and a gear 308. The gear 308 is engaged with the gear 307 mounted toward the outside of the end of the compression roller 301. Thus, the drive unit 306 is capable of controlling the rotation of the compression roller 301 accurately by controlling the driving of the stepping motor.

Controlling the drive unit 306 in order to synchronize the rotation of the compression roller 301 and the movement of the nonwoven fabric 210 (the sheet 160) allows compression of the nonwoven fabric 210 without it getting twisted.

Figure 8:
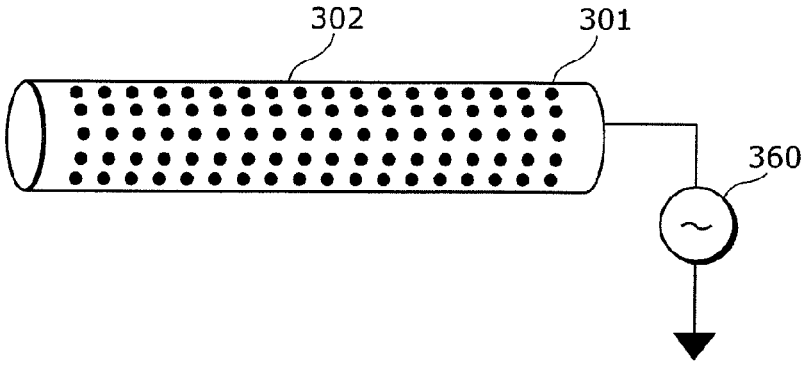
FIG. 8 shows a structure for charge neutralization of a compression roller.

In addition, as shown in FIG. 8, the AC power source 360 can apply an AC voltage to the compression roller 301. By applying the AC voltage to the compression roller 301 that directly contacts the charged nonwoven fabric 210, it becomes possible to perform charge neutralization on the nonwoven fabric 210 and to prevent the nonwoven fabric 210 from attaching to the compression roller 301. In the case that the superheated steam 350 performs charge neutralization on the nonwoven fabric 210, the AC source 360 for the charge neutralization may not be necessary. The superheated steam 350 is not limited to this, but hot air with a predetermined temperature may be sprayed from the spraying holes 302 of the compression roller 301.

Figure 9:
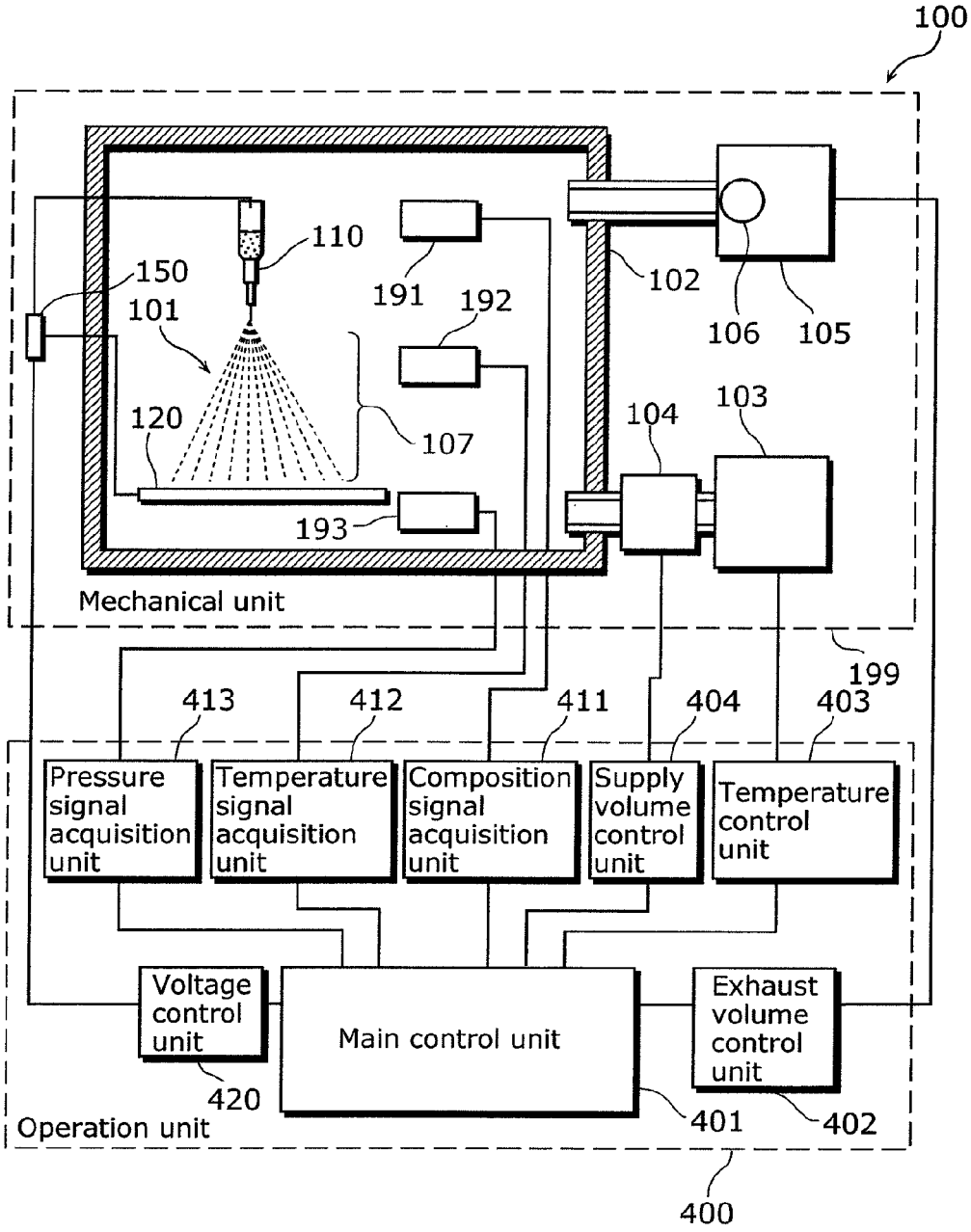
FIG. 9 is a block diagram showing a control structure of the nonwoven fabric manufacturing apparatus.

FIG. 9 is a block diagram showing an operational structure of the nonwoven fabric manufacturing apparatus 100 together with a mechanical unit.

As shown in the figure, the nonwoven fabric manufacturing apparatus 100 includes, in the inside space of the partition 102, a gas composition sensor 191 as a gas composition measuring unit, a temperature sensor 192 as a temperature measuring unit, and a pressure sensor 193 as a pressure measuring unit, other than the above described structure. The nonwoven fabric manufacturing apparatus 100 also includes a gas supply volume change unit 104 and an exhaust fan 106.

The gas composition sensor 191 is an apparatus which is capable of detecting at least a certain gas from the atmosphere that exists in the manufacturing space of the inside of the partition 102 and providing the signal which corresponds to the concentration of the detected gas. Examples of the gas composition sensor 191 include a sensor which is capable of detecting oxygen and measuring its concentration, and a sensor which is capable of detecting nitrogen and measuring its concentration. In addition, a sensor may be used which is capable of distinctly detecting kinds of gas included in the atmosphere and measuring it's ratio.

The temperature sensor 192 is a sensor which is capable of measuring the temperature in the manufacturing space of the inside of the partition 102 and providing the signal which corresponds to the measured temperature. Examples include a thermocouple and an infrared thermometer. The infrared thermometer can measure the temperature of the inside space even from the outside space of the partition 102.

The pressure sensor 193 is a sensor which is capable of providing the signal which corresponds to the pressure of the inside space of the partition 102. Examples include a sensor which is capable of changing the microscopic displacement of the diaphragm into an electric signal.

The gas supply volume change unit 104 is placed in the middle of the tube which is inserted from the gas supply source 103 to the inside space of the partition 102, and is capable of controlling, by a valve, the gas volume flows inside of the tube, that is flow rate of the gas, and changing the volume of the gas supplied from the gas supply source 103 to the inside space of the partition 102. For this embodiment, the gas supply volume change unit 104 is capable of making the inside of the tube into a condition where it closes completely.

The exhaust fan 106 is mounted to the inside of the exhaust apparatus 105, and is capable of absorbing, by rotating the fan, the atmosphere of the inside space of the partition 102, via the tube inserted from the exhaust apparatus 105 to the inside space of the partition 102. In addition, the exhaust apparatus 105 includes a switching unit which is capable of selecting whether exhausting is performed or not, at a position closer to the partition 102 than the exhaust fan 106.

As shown in the figure, the nonwoven fabric manufacturing apparatus 100 also includes, as the operation unit 400, a main control unit 401, an exhaust volume control unit 402, a temperature control unit 403, a supply volume control unit 404, a composition signal acquisition unit 411, a temperature signal acquisition unit 412, a pressure signal acquisition unit 413 and a voltage control unit 420.

The composition signal acquisition unit 411 is a processing unit which acquires the signal from the gas composition sensor 191, converts the acquired signal into the digital signal, and transmits the converted digital signal to the main control unit 401.

The temperature signal acquisition unit 412 is a processing unit which acquires the signal from the temperature sensor 192, converts the acquired signal into the digital signal, and transmits the converted digital signal to the main control unit 401.

The pressure signal acquisition unit 413 is a processing unit which acquires the signal from the pressure sensor 193, converts the acquired signal into the digital signal, and transmits the converted digital signal to the main control unit 401.

The main control unit 401 is a processing unit which analyzes signals from the respective sensors 191, 192 and 193. The main control unit 401 is also the processing unit which performs feedback control on the gas supply volume change unit 104 or the exhaust fan 106 via the supply volume control unit 404 or the exhaust volume control unit 402. With the above structure, the main control unit 401 allows maintaining the inside space of the partition 102 at a predetermined atmosphere. The main control unit 401 controls, via the temperature control unit 403, the superheated steam generating apparatus mounted to the gas supply source 103 which shall be described later, so that the temperature of the superheated steam 350 supplied to the inside space of the partition 102 can be controlled. The main control unit 401 also controls, via the voltage control unit 420, the power source 150 which gives the electric potential between the ejection unit 110 and the collecting electrode 120, so that a predetermined voltage between the ejection unit 110 and the collecting electrode 120 can be generated.

The exhaust volume control unit 402 is a processing unit which is connected to the exhaust fan 106 and is capable of controlling the number of rotations of the exhaust fan 106 so that the absorbed volume of the atmosphere in the inside space of the partition 102 can be controlled.

The temperature control unit 403 is a processing unit which is connected to the superheated steam generating apparatus which shall be described later, and is capable of controlling the temperature of the superheated steam 350 supplied to the inside space of the partition 102.

The supply volume control unit 404 is a processing unit which is connected to the gas supply volume change unit 104 and is capable of changing the switching condition of the valve included in the gas supply volume change unit 104 so that the flow rate of the gas supplied from the gas supply source 103 can be controlled.

The voltage control unit 420 is a processing unit which is connected to the power source 150 and is capable of controlling the power source so that a predetermined voltage can be generated.

The superheated steam generating apparatus serving as the gas supply source 103 is an apparatus which is capable of heating saturated water vapor under the normal pressure to become 100° C. or more so that normal pressure superheated steam can be generated. For this embodiment, the temperature control unit 403 is capable of arbitrarily setting the temperature of the superheated steam 350 supplied to the inside space of the partition 102 up to 500° C. Examples of methods for heating saturated water vapor include heating by an electric fire or heating by burning fuel; however, for this embodiment, the method is used in which a plurality of metal pipes are bundled together, the metal pipes are heated by induction heating, and saturated water vapor is passed through each metal pipe, in order to generate the superheated steam.

More specifically, the metal pipes are heated by a high-frequency power source (frequency of 10 kHz or more and 60 kHz or less). The saturated water vapor is supplied from a boiler.

When the superheated steam generating apparatus is used as the gas supply source 103 here, the superheated steam ($H_2O$ gas) is supplied to the inside space of the partition 102. In this case, the oxygen concentration of the supplied superheated steam ranges from 0.1 vol % to 15 vol %, and is normally maintained in the range from 0.3 vol % to 5.0 vol %. By filling the inside space of the partition 102 with the superheated steam having low oxygen concentration as described above, it becomes possible to change the atmosphere of the inside space of the partition 102 at low oxygen atmosphere.

Since the superheated steam has a high radiant heat transfer effect in addition to the high convection heat transfer effect, the volatilization of the solvent included in the solution 200 for manufacturing nano-fibers can be accelerated more, allowing the manufacture of the nano-fibers to be easily performed. In other words, even when a hard volatile solvent is used, the hard volatile solvent is evaporated by the heat energy given by the superheated steam 350 in the manufacturing space 107 and an electrostatic explosion is generated, thereby manufacturing the nano-fibers. This indicates that it is possible to expand the kinds of selectable solvents, which allow the use of solvents which are low-cost and environmental friendly.

Next, the overall structure of the nonwoven fabric manufacturing apparatus 100 shall be described.

Figure 10:
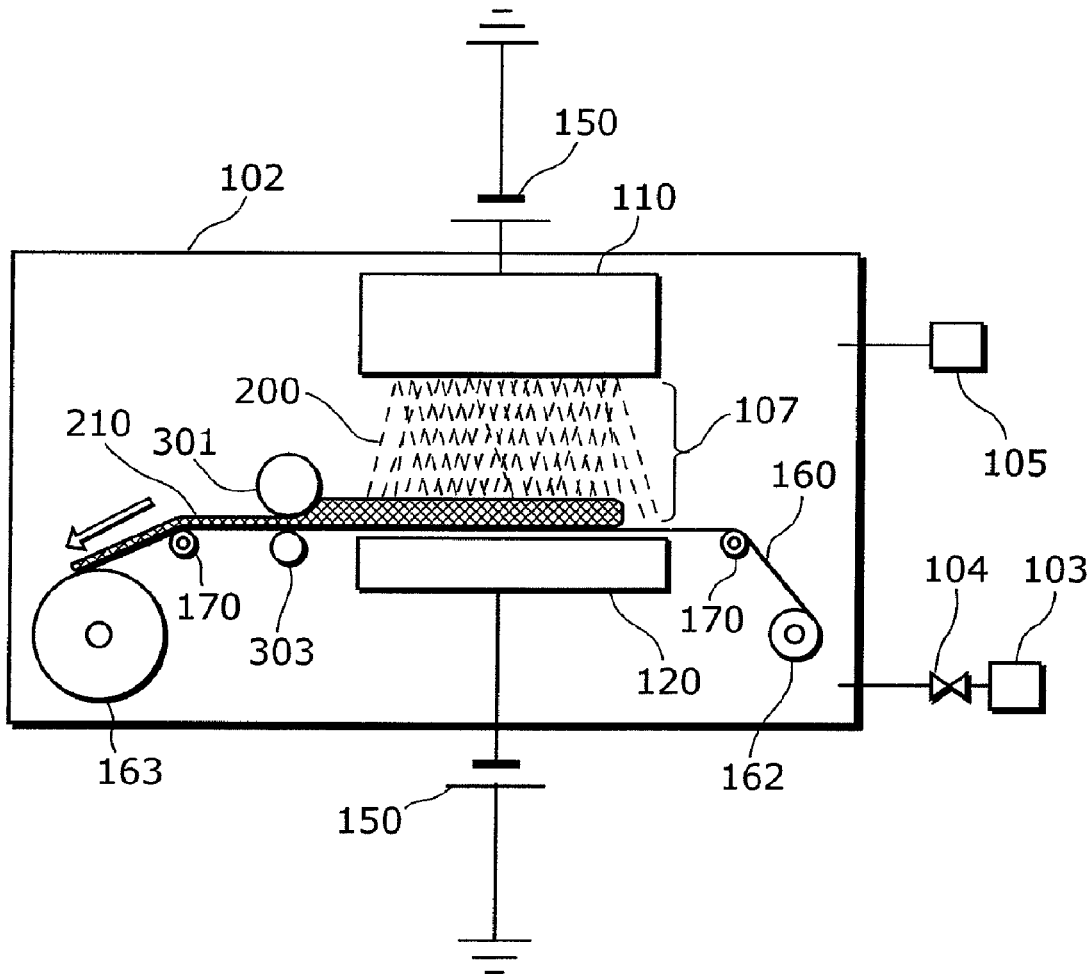
FIG. 10 is a lateral view schematically showing the manufacturing state of the nonwoven fabric.

FIG. 10 is a lateral view schematically showing the nonwoven fabric manufacturing apparatus.

As shown in the figure, the nonwoven fabric manufacturing apparatus 100 is enclosed by the partition 102. The ejection unit 110 ejects the solution toward the sheet 160 placed at the bottom. The distance between the ejection unit 110 and the sheet 160 is set to such a distance that the electrostatic explosion is generated several times and the nano-fibers with the desired diameter can be obtained.

A predetermined electric potential difference is generated between the collecting electrode 120 placed under the sheet 160 and the ejection unit 110. Such electric potential difference is controlled by the power source 150 which is independently connected to the ejection unit 110 and the collecting electrode 120. In other words, the power source 150 is configured to independently supply a voltage to the ejection unit 110 and the collecting electrode 120, respectively.

At the downstream of the collecting electrode 120 in the moving direction of the sheet 160 (arrow shown in the figure), the compression roller 301 and the pinch roller 303 are placed so as to sandwich the sheet 160 and the nonwoven fabric 210.

The sheet 160 is supplied from the sheet supply roll 162 which have the long sheet 160 wound around, and the nonwoven fabric 210 in the compressed state is wound into the winding roll 163 together with the sheet 160.

Next, a manufacturing method of nonwoven fabric according to the nonwoven fabric manufacturing apparatus 100 with the above structure shall be described.

First, the superheated steam 350 is supplied to the inside space of the partition 102. At the same time, the exhaust apparatus 105 absorbs the atmosphere of the inside space of the partition 102. As described above, supplying the superheated steam 350 and simultaneously absorbing the atmosphere cause the inside space of the partition 102 to reach an equilibrium state with a predetermined temperature, a predetermined pressure and a predetermined oxygen concentration. The oxygen concentration, temperature and pressure are monitored by the gas composition sensor 191, the temperature sensor 192 and the pressure sensor 193 respectively, and the gas supply volume change unit 104, the exhaust fan 106 and the generation temperature of the superheated steam of the gas supply source 103 (superheated steam generating apparatus) are controlled so that each of the oxygen concentration, temperature and pressure become a predetermined value.

Next, the ejection unit 110 ejects the solution from the plurality of ejection holes 112. As a result, the atmosphere of the inside space of the partition 102 is changed; and therefore the gas supply volume change unit 104, the exhaust fan 106 and the generation temperature of the superheated steam of the gas supply source 103 (superheated steam generating apparatus) are controlled again.

In the above described atmosphere, the solvent is evaporated from the solution for manufacturing nano-fibers and the electrostatic explosion is repeated, which allows the nano-fibers 200 to be manufactured. Then the manufactured nano-fibers 200 are attracted to the collecting electrode, and the nano-fibers are deposited on the sheet 160.

The sheet 160 on which the nano-fibers 200 are deposited is moved at a predetermined moving speed. The moving speed of the sheet 160 can be obtained by calculating the deposition speed of the nano-fibers 200 and the desired condition of the nonwoven fabric 210 (density, for example).

The nonwoven fabric 210 thus deposited on the sheet 160 and manufactured is in a so called fluffy state. The nonwoven fabric 210 in such a state is moved together with the sheet 160.

At the downstream of the moving direction of the sheet 160, the compression roller 301 and the pinch roller 303 compress the nonwoven fabric 210 which is in the fluffy state, and simultaneously the superheated steam sprayed from the compression roller 301 against the nonwoven fabric 210 heats the part being compressed so that the solvent that remains on the nonwoven fabric can be evaporated and the nonwoven fabric 210 can be dried.

Here, the thickness of the nonwoven fabric 210 is determined according to the settings of the thickness of the nonwoven fabric 210 immediately after the deposition and the suppress strength of the pressure unit 305. Such settings are determined depending on the conditions such as the kinds of polymer included in the nano-fibers 200 and the solvent to be used.

Manufacturing the nonwoven fabric as described above allows manufacturing the nano-fibers at low oxygen atmosphere; therefore it is possible to prevent an explosion caused by electric discharge from the collecting electrode 120 or the like from happening even when a flammable solvent is used for the solution for manufacturing the nano-fibers. Furthermore, the solution is heated by the superheated steam, and therefore the electrostatic explosion can be induced even when the hard volatile solvent is used. In other words, using superheated steam prevents explosions and also expands the kinds of solvents which can be used.

Then, it becomes possible to easily manufacture the nonwoven fabric 210 with the desired thickness, density, mechanical strength and surface area per unit volume in the state where there is no concern about an explosion.

It should be noted that for the above described embodiment, the shaft 309 supporting the compression roller 301 and the gas supply source 103 are connected, and the superheated steam 350 is supplied from the spraying holes 302 provided around the peripheral wall of the compression roller 301, but the present invention is not limited to this. For example, as shown in FIG. 10, gas may be supplied directly to the inside space of the partition 102.

Figure 11:
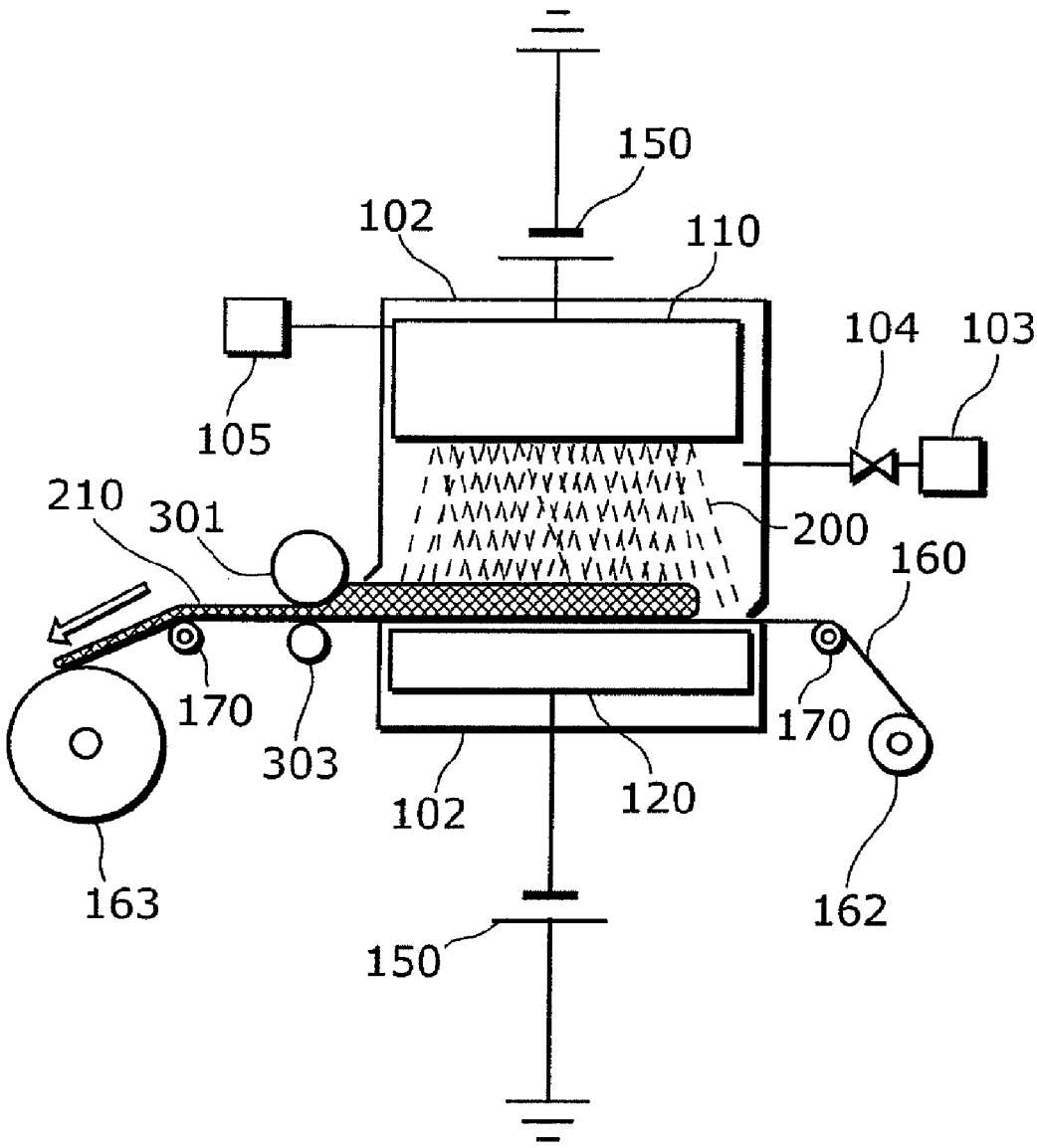
FIG. 11 is a lateral view schematically showing another aspect of a partition.

In addition, the low oxygen atmosphere may be made only at the manufacturing space 107 that is the manufacturing space sandwiched by the ejection unit 110 and the collecting electrode 120. Thus, as shown in FIG. 11, the partition 102 may enclose only near the manufacturing space 107.

Furthermore, it is also possible to seal the manufacturing space 107 by the partition 102 and to balance the gas volume supplied from the gas supply source 103, the exhaust volume by the exhaust apparatus 105 and the ejection volume of the solution for manufacturing nano-fibers, so that a constant atmosphere of the inside space sealed by the partition 102 can be maintained and the low oxygen state can be maintained.

Furthermore, gas exhausted by the exhaust apparatus 105 may be introduced again to the inside space of the partition 102. In this case, it is possible to control the gas volume supplied from the gas supply source 103 and to easily maintain the temperature of the inside space of the partition 102, which are desirable.

Furthermore, a heater such as a sheath heater may be included in the inside of the partition 102 so that a constant temperature of the inside space of the partition 102 can be maintained. By heating the gas supplied from the gas supply source 103 using the heater and introducing the heated gas to the inside space of the partition 102, the temperature of the inside space of the partition may be made at a predetermined temperature.

The above described embodiment indicates the case for manufacturing nonwoven fabric, but the present invention is also applicable to spinning techniques or the like which uses nano-fibers.

Embodiment 2

Figure 12:
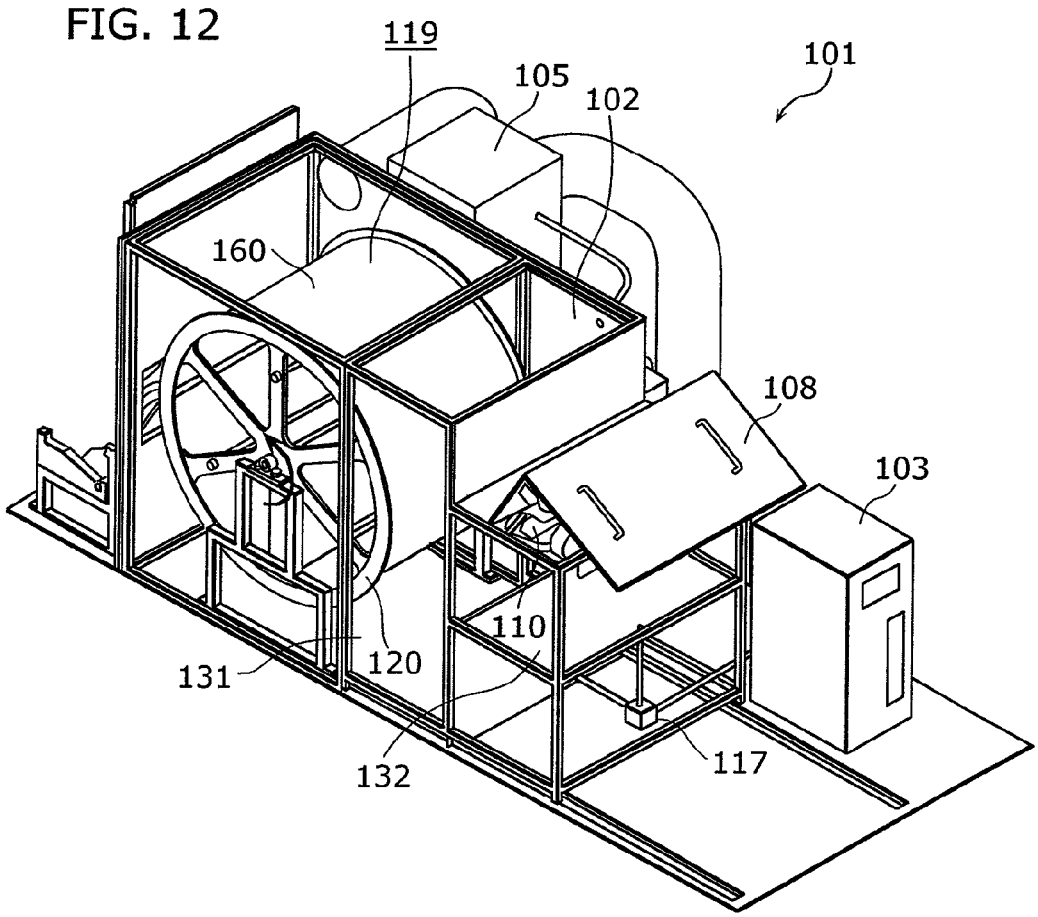
FIG. 12 is a perspective view schematically showing the nano-fiber manufacturing apparatus according to the present invention.

FIG. 12 is a perspective view schematically showing the nano-fiber manufacturing apparatus according to the present invention.

Figure 13:
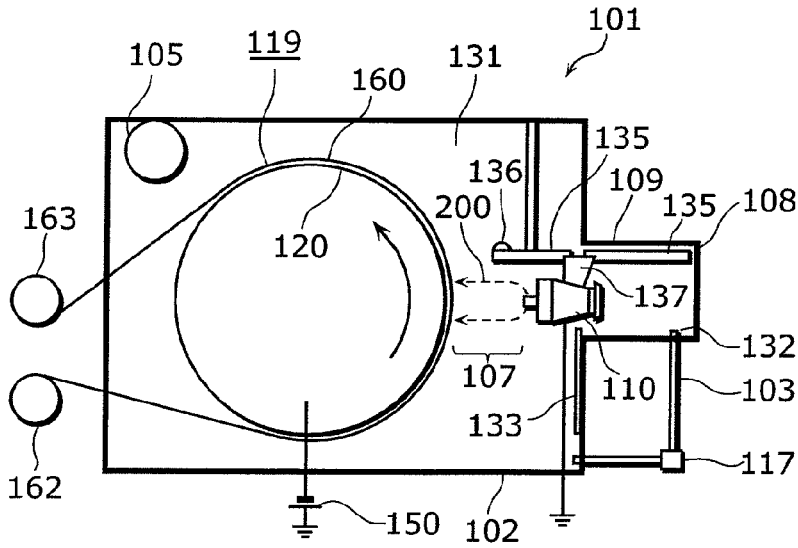
FIG. 13 is a lateral view schematically showing the nano-fiber manufacturing apparatus.

FIG. 13 is a lateral view schematically showing the nano-fiber manufacturing apparatus.

As shown in the figure, the nano-fiber manufacturing apparatus 101 includes the ejection unit 110, the collecting unit 119, the partition 102, a slide unit 109, the gas supply source 103 and the exhaust apparatus 105. Since it is difficult to clearly distinguish nano-fibers being manufactured and the solution, the reference numeral 200 is assigned to both of them.

The ejection unit 110 is an apparatus which ejects (discharges) solution as raw material liquid for manufacturing nano-fibers, and is connected to the power source or grounded so that a predetermined electric potential can be maintained. The ejection unit 110 is connected to the tank storing the solution (not shown) via the pipe and the solution is supplied at a predetermined pressure.

Figure 14:
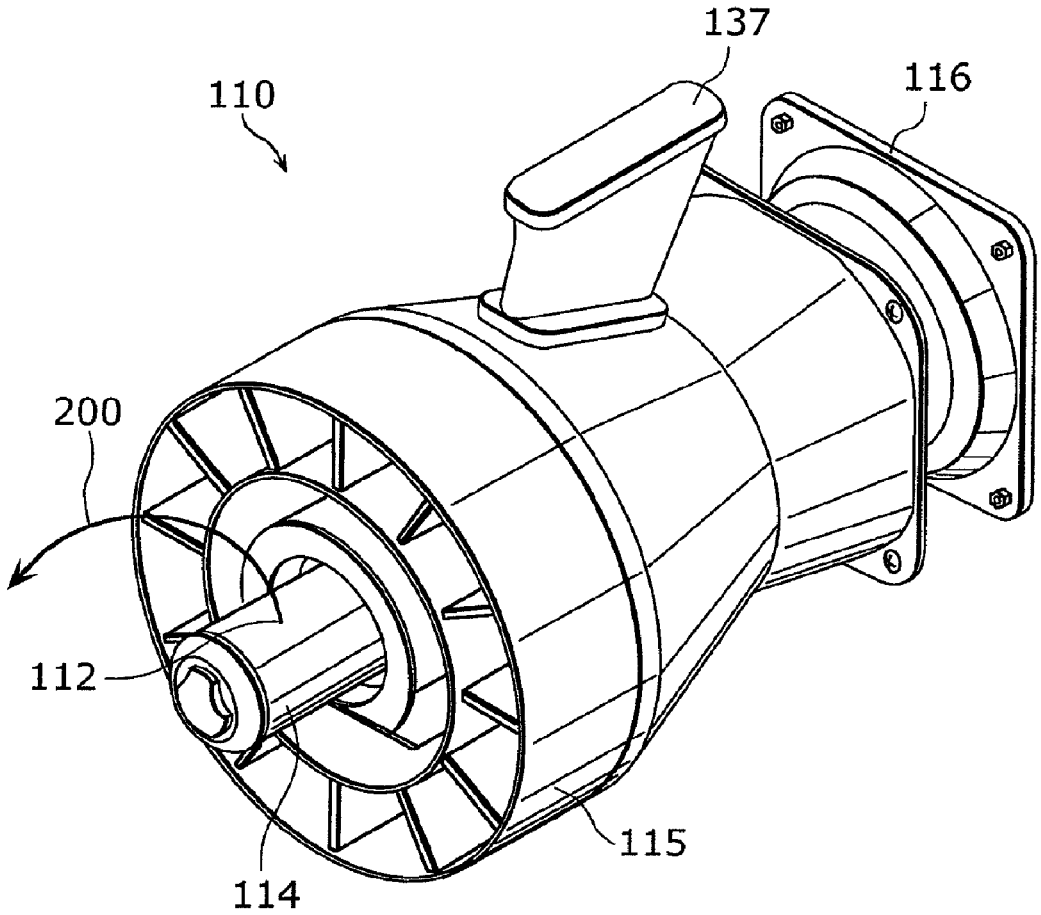
FIG. 14 is a perspective view showing a specific example of the ejection unit.

FIG. 14 shows a specific example of the ejection unit.

As shown in the figure, the ejection unit 110 is an apparatus which ejects the solution 200 to the manufacturing space, and includes the barrel (sometimes referred to as rotary cylinder) 114, an air flow controlling fin 115, a fan 116 and a mounting portion 137. Although only one arrow indicating a stream of the solution 200 is shown in the figure, a number of streams of the solution 200 are actually ejected from the entire peripheral wall of the barrel 114.

The barrel 114 is provided with a plurality of ejection holes 112 around the peripheral wall, and is a rotatable cylindrical cylinder which is made of conductive materials and has a sealed tip. The barrel 114 is to which a predetermined electric potential is given by the power source or in which the ground state is maintained. The barrel 114 also has a base end connected to the pipe which supplies the solution 200 and the solution 200 is supplied to the inside of the barrel 114.

The air flow controlling fin 115 is a fin which controls the air flow generated from the fan 116 so that the traveling direction of the solution 200 ejected radially and outwardly from the barrel can be changed to the axial direction of the barrel 114 (see the arrow shown in the figure). The air flow controlling fin 115 is placed at the base end of the barrel 114 so as to surround the barrel 114.

The fan 116 generates wind which changes the traveling direction of the solution 200 ejected from the barrel 114.

The mounting portion 137 is a member which is engaged with the slide unit 109 so that the ejection unit 110 can be placed at a predetermined position.

The collecting unit 119 shown in FIG. 12 and FIG. 13 is an apparatus which collects the nano-fibers 200 manufactured by the electrostatic explosion, and includes the collecting electrode 120 and the sheet 160.

The collecting electrode 120 is a metal electrode to which the electric potential is given by the power source 150 so that a predetermined electric potential difference between the ejection unit 110 and the collecting electrode 120 is generated. The collecting electrode 120 is placed on the opposite side of the ejection unit 110 with respect to the sheet 160 so as to oppose the ejection unit 110. The collecting electrode 120 serves to electrically attract the charged nano-fibers 200 manufactured through the ejection from the ejection unit 110, and allow depositing the nano-fibers 200 on the sheet 160. For this embodiment, the collecting electrode 120 is a cylindrical shape of 50 cm to a few meters in diameter, and is capable of rotating in synchronization with the movement of the sheet 160 placed along the outer periphery of the collecting electrode 120.

The sheet 160 is a member on which the nano-fibers 200 manufactured in the manufacturing space are deposited, and a long sheet which is thin and flexible and made of materials easily separable from the deposited nano-fibers 200. The sheet 160 is supplied being wound into a roll from the supply roll 162, and slowly moves the deposition area of the nano-fibers 200. Then, the sheet 160 is wound into a roll again around the winding roll 163 together with the nano-fibers 200 deposited in a nonwoven fabric like state on the sheet 160. The supply roll which has the sheet 160 wound around and the roll which is wound together with the nano-fibers 200 around are both placed in the outside space of the partition 102.

The partition 102 is made of a nonporous member, and is a member which forms the first working chamber 131 covering the nano-fiber manufacturing apparatus 101 almost entirely, and the second working chamber 132 connected to the first working chamber 131. Examples of the partition 102 include a boxing assembled with resinous panels or a metallic frame with a flexible and nonporous sheet stretched. The floor on which the nano-fiber manufacturing apparatus 101 is placed may be used as the partition 102. In order to show the internal structure of the nano-fiber manufacturing apparatus 101, FIG. 12 shows the state where the partition 102 of the ceiling and the front side wall of the first working chamber 131 and the partition 102 of the front side wall of the second working chamber 132 are removed and only the frame is left.

The first working chamber 131 is a chamber which includes the manufacturing space 107 inside of which the solution changes into the nano-fibers while traveling, and is formed by being enclosed by the partition 102 so that the inside and the outside of the chamber can be maintained at different atmospheres. Thus, the first working chamber 131 can be maintained at lower oxygen condition compared to the outside of the chamber by introducing safety gas from the gas supply source 103, and is formed by being enclosed by the floor serving as the partition 102 and the partition 102. The inside of the first working chamber 131 includes the ejection unit 110, the collecting unit 119 and the manufacturing space where the nano-fibers 200 are manufactured by the electrostatic explosion.

The second working chamber 132 is connected to one side of the partition 102 which forms the first working chamber 131, and is formed with the partition 102 similarly to the first working chamber 131. The second working chamber 132 is formed to be such a size that only the ejection unit 110 can be housed, and is smaller than the first working chamber 131. The second working chamber 132 includes a first door 108, and a worker can access the inside of the second working chamber 132 by opening the first door 108. For this embodiment, the first door 108 is formed by integrating the partition 102 which is the ceiling of the second working chamber 132 and the partition 102 which is the side wall of the second working chamber 132, and is capable of opening the second working chamber 132 widely.

A first gate 133 is provided between the first working chamber 131 and the second working chamber 132 so that the ejection unit 110 can pass through. The first gate 133 is capable of moving up and down along the partition 102 of the inside of the first working chamber 131, and the first working chamber 131 and the second working chamber 132 are completely separated from each other when the first gate 133 reaches the top. When the first gate 133 reaches the bottom, the ejection unit 110 is movable between the first working chamber 131 and the second working chamber 132. When the first gate 133 reaches the bottom, the atmosphere in the first working chamber 131 and the atmosphere in the second working chamber 132 can flow freely between the chambers; however, the inside of the first working chamber 131 and the second working chamber 132 are maintained being completely separated from the outside of the chambers.

The slide unit 109 is an apparatus which allows the ejection unit 110 to move between the first working chamber 131 and the second working chamber 132, and includes a rail 135 which is engaged with the mounting portion 137 and a drive unit 136 which moves the ejection unit 110.

The rail 135 is provided across the first working chamber 131 and the second working chamber 132, but the portion where the first gate 133 passes through is divided.

The gas supply source 103 is an apparatus which supplies safety gas to the first working chamber 131 and the second working chamber 132. The gas supply source 103 is capable of switching over, by using a switching valve 117, whether safety gas is supplied to the first working chamber 131 or the second working chamber 132. The gas supply source 103 is also capable of supplying safety gas to the first working chamber 131 and the second working chamber 132 at the same time. Furthermore, the gas supply source 103 is capable of not only supplying safety gas, but also supplying air by pressure.

Examples of safety gas supplied from the gas supply source 103 include low oxygen concentration gas in which a certain amount of oxygen is removed from air by using a resin film (hollow fiber membrane) and superheated steam.

Here, low oxygen concentration indicates lower concentration than oxygen concentration of air. More specifically, low oxygen concentration indicates lower concentration than critical oxygen concentration in which evaporated solvents do not explode. The description here does not exclude the use of high purity gas which hardly contains oxygen, but, for example, high purity nitrogen sealed in a cylinder in the form of liquid or gas, or carbon dioxide supplied from dry ice may also be used.

The exhaust apparatus 105 is an apparatus which is capable of exhausting the atmosphere (low oxygen concentration gas and evaporated solvent) that exists in the first working chamber 131 and the second working chamber 132. The exhaust apparatus 105 is capable of selecting whether exhausting the atmosphere is performed in the first working chamber 131 or the second working chamber 132, and also exhausting the atmosphere both in the first working chamber 131 and the second working chamber 132 at the same time. The exhaust apparatus 105 can also set a separate exhaust volume of the atmosphere for the first working chamber 131 and the second working chamber 132, respectively. In addition, the exhaust apparatus 105 includes the recovery apparatus which is capable of recovering solvent or the like contained in the exhausted atmosphere.

The balance between the gas supply volume of the gas supply source 103 and the gas exhaust volume of the exhaust apparatus 105 allows maintaining the inside of the first working chamber 131 at a positive pressure. Here, positive pressure indicates the state in which the pressure of the inside space is higher than the pressure of the outside space of the partition.

The power source 150 is an apparatus which is capable of generating a voltage which ranges from 2 kV or more to 200 kV or less between the power source 150 and the grounded ejection unit 110.

Examples of the solution for manufacturing nano-fibers include solution made by dissolving or mixing organic solvent to epoxy resin, polyimide resin, LCP (Liquid Crystal Polymer) resin or the like.

Further examples of substances used as solute include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide. One kind of substances selected from among the above examples may be used, or various kinds of substances may be mixed at a predetermined ratio.

In addition, inorganic solid material can be added to the solution. By adding inorganic solid material, it is possible to change the properties of the nano-fibers to be obtained. Examples of inorganic solid material include metals, oxides, carbides, nitrides, borides, silicides, fluorides, and sulfides. Furthermore, specific examples of inorganic solid material include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $AS_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. One kind of materials selected from among the above examples may be used, or various kinds of materials may be mixed at a predetermined ratio.

As for solvents that can be used in the solution, it is preferable to use substances which allow the solution to be evaporated (volatilized) while traveling the manufacturing space. Specific examples include acetonitrile, toluene, dichloromethane, alcohol such as methanol and ethanol, and acetone. Further examples include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water. One kind of substances selected from among the above examples may be used, or various kinds of substances may be mixed at a predetermined ratio.

Preferred ratio of solvents included in the solution is approximately from 60% to 98%, which is determined by the kinds of fiber materials and solvents to be used, diameter of fibers to be manufactured or the like.

Next, the outline of the manufacturing method of the nano-fibers 200 shall be described.

First, safety gas is supplied to the first working chamber 131. At the same time, the exhaust apparatus 105 absorbs the atmosphere in the first working chamber 131. As described above, supplying inert gas and simultaneously absorbing the atmosphere cause the inside of the first working chamber 131 to reach an equilibrium state with a predetermined pressure and a predetermined oxygen concentration, and an explosion prevention condition is made.

Next, a predetermined voltage is applied to various parts of the ejection unit 110 and the collecting unit 119.

Next, the ejection unit 110 ejects the solution. The solvent included in the ejected solution 200 is evaporated while traveling, and the electrostatic explosion is repeated, which allows manufacturing the nano-fibers 200. Then the manufactured nano-fibers 200 are attracted to the collecting electrode 120, and the nano-fibers 200 are deposited on the sheet 160 supplied from the supply roll 162. The sheet 160 on which the nano-fibers 200 are deposited is moved at a predetermined moving speed, and the cylindrical collecting electrode 120 rotates with this movement. The nano-fibers 200 thus deposited in a nonwoven fabric like state on the sheet 160 is moved together with the sheet 160 and wound into the winding roll 163.

Manufacturing the nonwoven fabric as described above allows manufacturing the nano-fibers at low oxygen atmosphere; therefore it is possible to prevent an explosion caused by electric discharge from the collecting electrode 120 or the like from happening even when a flammable solvent is used for the solution for manufacturing the nano-fibers.

Next, the method of performing maintenance work on the nano-fiber manufacturing apparatus shall be described.

In the nano-fiber manufacturing apparatus 101, the apparatus which especially requires frequent maintenance (once half a day, for example) is the ejection unit 110. This is because the ejection holes 112 of the barrel 114 are clogged and the desired amount of the solution 200 cannot be ejected, thereby decreasing manufacturing capability of the nano-fibers. Therefore, maintenance work in which the barrel 114 is removed from the ejection unit 110 and replaced is frequently performed.

Figure 15:
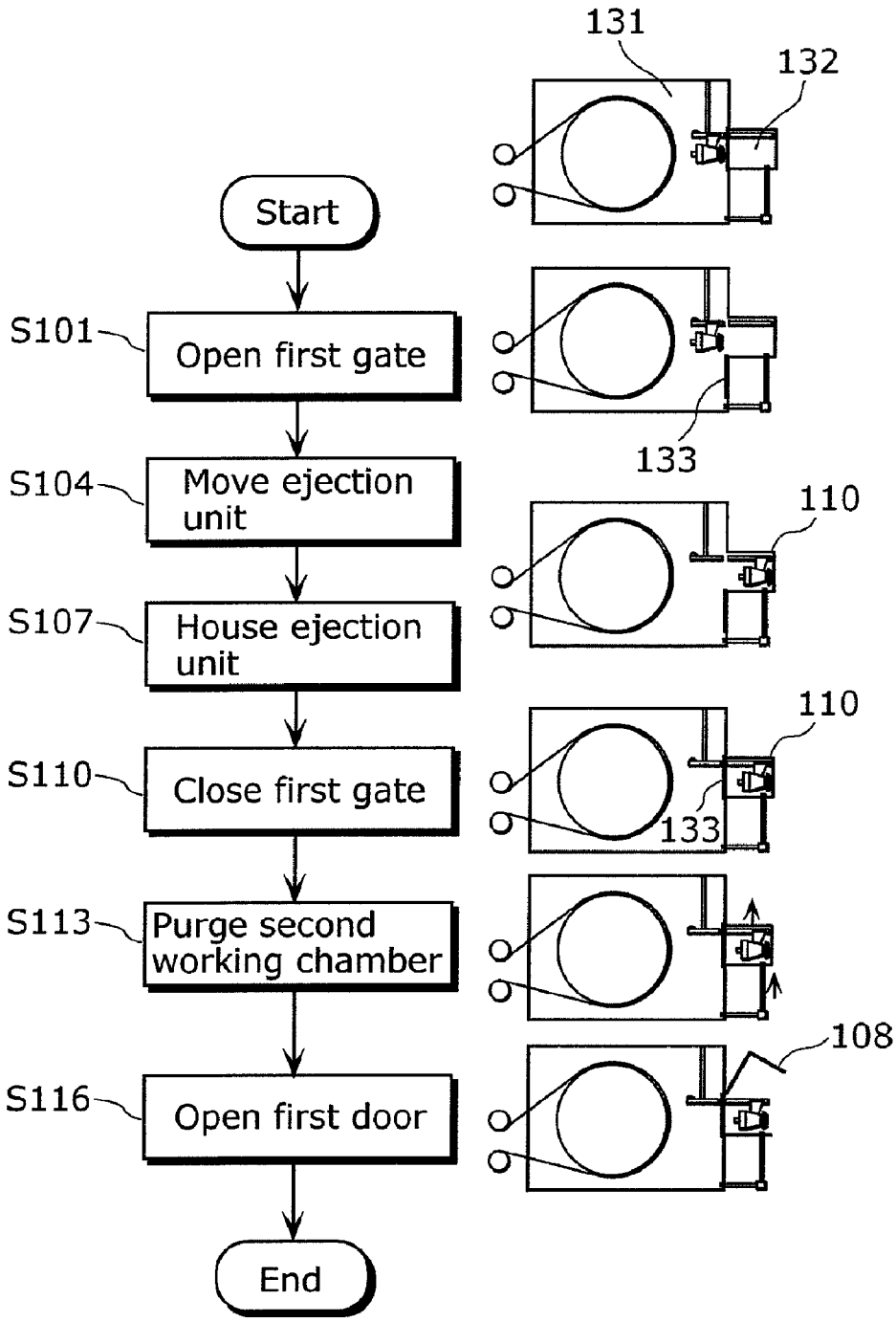
FIG. 15 is a flowchart showing the maintenance work process of the nano-fiber manufacturing apparatus, and a lateral view showing the state of the nano-fiber manufacturing apparatus corresponding to the respective work processes.

FIG. 15 is a flowchart showing the maintenance work process of the nano-fiber manufacturing apparatus, and a lateral view showing the state of the nano-fiber manufacturing apparatus corresponding to the respective work processes.

First, the first gate 133 is opened (S101). Next, the ejection unit 110 is moved toward the second working chamber 132 (S104). The ejection unit 110 is moved by the drive apparatus 136. The ejection unit 110 is moved to a predetermined position in the second working chamber 132 and the ejection unit 110 is housed in the second working chamber 132 (S107: Housing step). Next, the first gate 133 is closed between the first working chamber 131 and the second working chamber 132 (S110: Closing step). As a result, the ejection unit 110 is housed in the second working chamber 132 which is in a closed state, and at the same time, the first working chamber 131 and the second working chamber 132 are completely separated. Next, the atmosphere in the second working chamber 132 is exhausted by the exhaust apparatus 105 while air is being introduced to the second working chamber 132, so that the atmosphere in the second working chamber 132 can be purged (5113: Purging step). Here, purging the atmosphere in the second working chamber 132 is performed because purging the second working chamber 132 with safety gas prevents a worker who breathes during maintenance in the second working chamber 132 from becoming asphyxia.

On the other hand, the first working chamber 131 is maintained in such a condition that the exhaust volume of the atmosphere in the chamber and the introducing volume of safety gas to the chamber are suppressed. This is because consumption of safety gas can be suppressed, and also the first working chamber 131 is made at a positive pressure higher than the pressure of the outside of the chamber so that the introduction of air can be suppressed.

When the atmosphere in the second working chamber 132 is fully replaced with air, the second working chamber is opened by opening the first door 108 (S116: Opening step).

According to the above described processes, the ejection unit 110 can be easily accessed while maintaining the manufacturing space 107 in the first working chamber 131 at a low oxygen condition, which allows maintenance work on the ejection unit 110 to be performed easily. Especially, since the first door 108 can be opened widely toward the second working chamber 132, it is possible to perform maintenance work on all parts of the ejection unit even with the slide unit 109 being mounted to the ejection unit 110. In addition, the slide unit 109 includes a separation mechanism which can separate the slide unit 109 and the ejection unit 110 by pulling out the ejection unit 110, and the ejection unit 110 can be easily replaced by removing the ejection unit 110 from the slide unit 109 and mounting a new ejection unit 110.

Since purging is necessary only in the second working chamber 132 having a small volume, the time necessary for purging the second working chamber 132 can be dramatically shortened compared to the time necessary for purging the whole nano-fiber manufacturing apparatus 101, which allows the time consumed for performing maintenance work to be reduced.

Figure 16:
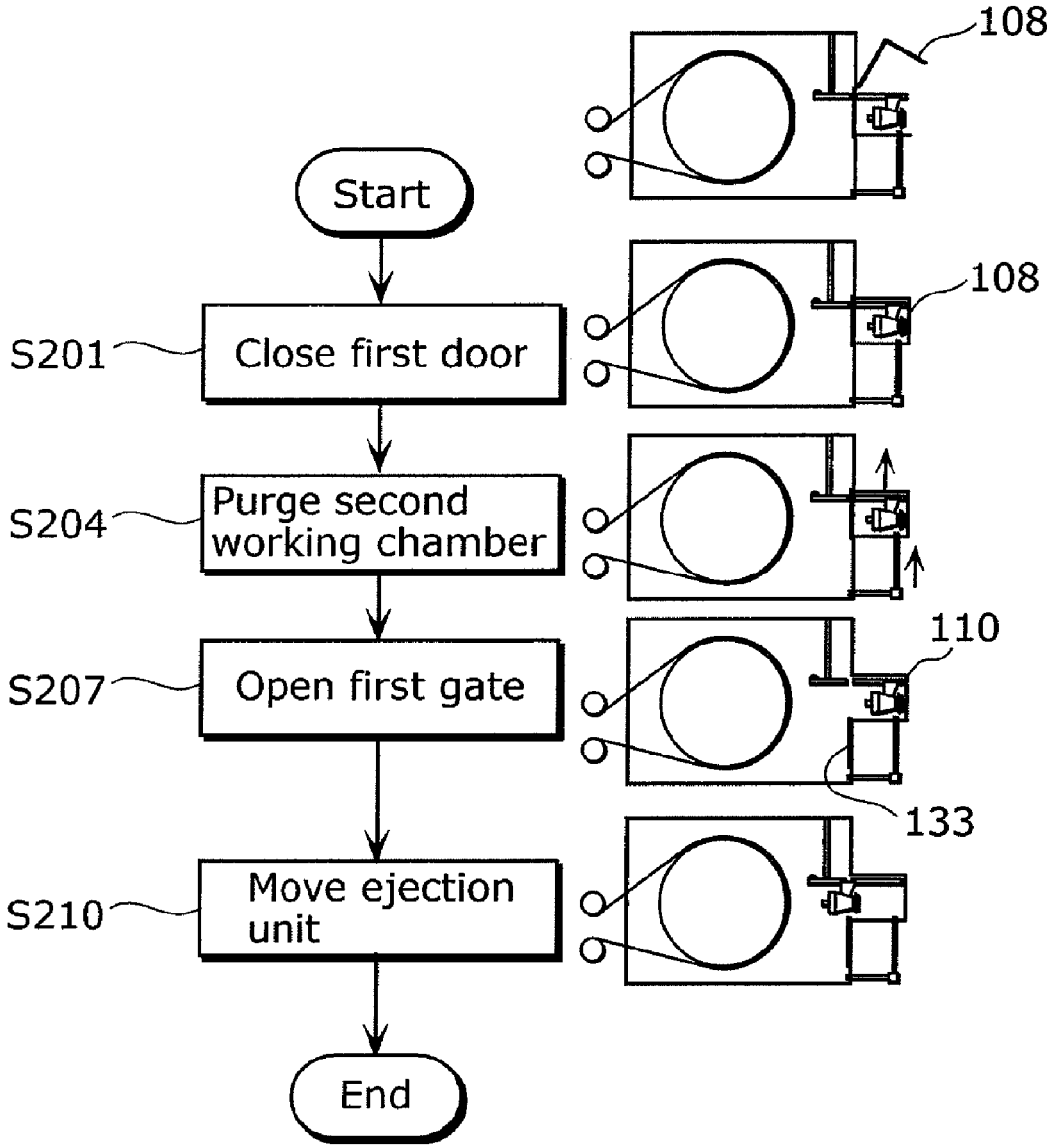
FIG. 16 is a flowchart showing a process of making the nano-fiber manufacturing state after the maintenance work is completed.

FIG. 16 is a flowchart showing a process of making the nano-fiber manufacturing state after the maintenance work is completed.

First, the ejection unit 110 after the maintenance work is set in the second working chamber 132, and the first door 108 is closed (S201). Next, air in the second working chamber 132 is purged with safety gas (S204). This purging process prevents air from flowing rapidly from the second working chamber 132 to the first working chamber 131 and oxygen concentration in the first working chamber 131 from falling within an explosive range.

Next, the first gate 133 is opened (S207), and the ejection unit 110 is moved toward the first working chamber 131 (S210). Here, the slide unit 109 can arbitrarily set the stop position of the ejection unit 110. This allows the distance between the collecting unit 119 and the ejection unit 110 to be changed according to manufacturing condition of nano-fibers. Furthermore, when it is necessary to set the distance between the collection unit 119 and the ejection unit 110 long, it is also possible to manufacture nano-fibers in such a condition that the first gate 133 is opened and some parts or whole parts of the ejection unit 110 are placed in the second working chamber 132.

According to the above described method, it is possible to start manufacturing nano-fibers again while maintaining low oxygen condition in the first working chamber 131. In addition, with this method, changing only the atmosphere in the second working chamber 132 from the air into a low oxygen condition is only necessary in order to shift to the manufacturing state of nano-fibers, which allows the time necessary for making the maintenance state to nano-fibers manufacturing state to be shorten dramatically.

Furthermore, with the above described method using the above described manufacturing apparatus, maintenance work on the ejection unit 110 can be performed easily without leaking evaporated solvents to the outside of the chamber, and effects on the human body and environment can be reduced as much as possible.

Embodiment 3

Figure 17:
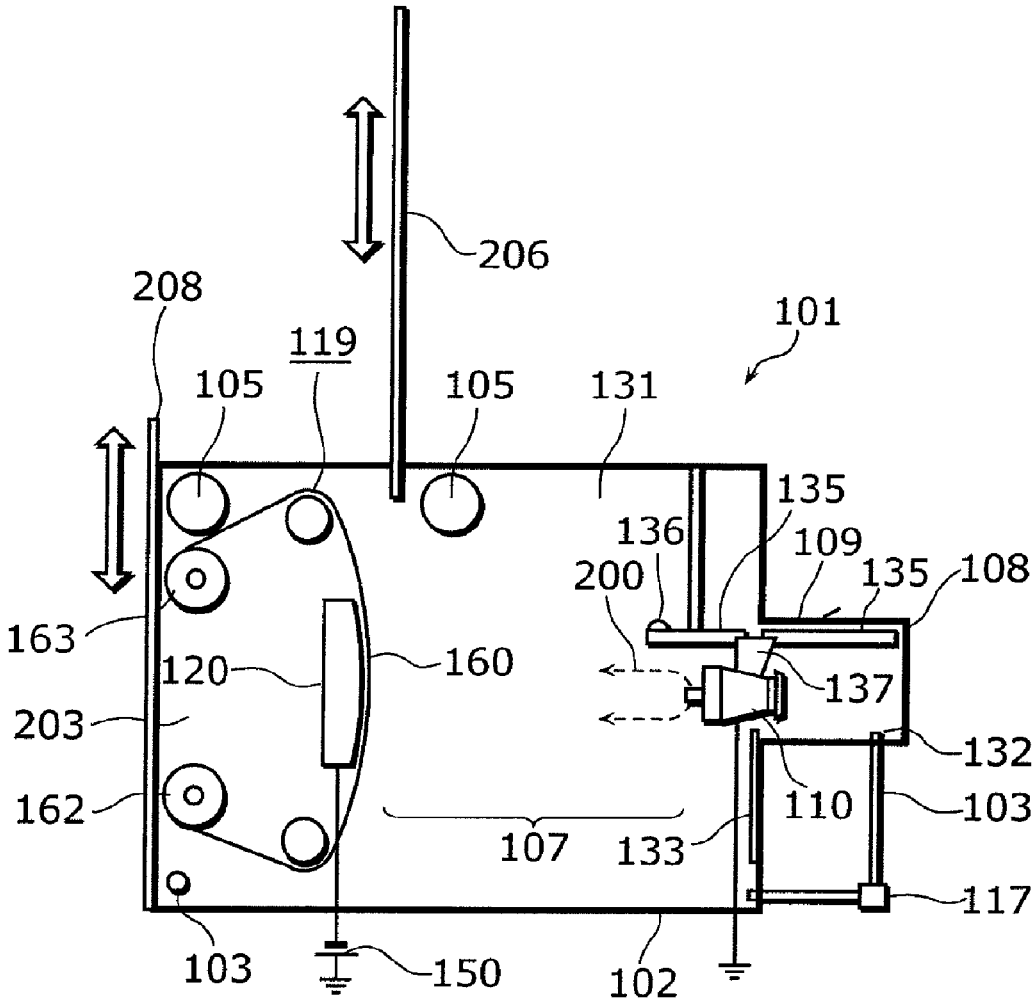
FIG. 17 is a lateral view schematically showing another aspect of the nano-fiber manufacturing apparatus according to the present invention.

FIG. 17 is a lateral view schematically showing another aspect of the nano-fiber manufacturing apparatus in accordance with the present invention.

The nano-fiber manufacturing apparatus 101 shown in the figure includes components common to components that appear in the above described embodiment 1. Thus, the same reference numerals are assigned to those common components, and descriptions of them may be omitted.

As shown in the figure, the nano-fiber manufacturing apparatus 101 includes the ejection unit 110, the collecting unit 119, the partition 102, the slide unit 109, the gas supply source 103 and the exhaust apparatus 105, and the structure of the nano-fiber manufacturing apparatus 101 is common to the above described embodiment 1.

The collecting unit 119 includes the collecting electrode 120 and the sheet 160, and is housed together with the supply roll 162 and the winding roll 163 in the third working chamber 203 which shall be described later.

The collecting electrode 120 is a metal member which includes a bulging surface, and is mounted in a resting state.

The partition 102 forms the first working chamber 131, the second working chamber 132 connected to the first working chamber 131, and the third working chamber 203.

The third working chamber 203 is connected to the partition 102, which forms the first working chamber 131, on the opposite side of the second working chamber 132, and is formed with the partition 102 similarly to the first working chamber 131. The third working chamber 203 is formed to be such a size that the collecting unit 119 can be housed. In addition, the third working chamber 203 includes a second door 208 which moves up and down by sliding, and, by opening the second door 208, a worker can access the inside of the third working chamber 203 and take out the whole collecting unit 119.

A second gate 206 is provided between the first working chamber 131 and the third working chamber 203. The second gate 206 is placed at the boundary area between the first working chamber 131 and the third working chamber 203 and can move up and down, and the first working chamber 131 and the third working chamber 203 are completely separated from each other when the second gate 206 reaches the bottom. When the second gate 206 reaches the top, collecting the manufactured nano-fibers 200 by the collecting unit 119 is not disturbed. When the second gate 206 reaches the top, the atmosphere in the first working chamber 131 and the atmosphere in the third working chamber 203 can flow freely between the chambers; however, the inside of the first working chamber 131, the second working chamber 132 and the third working chamber 203 are maintained being completely separated from the outside of the chambers.

Each of the first working chamber 131, the second working chamber 132 and the third working chamber 203 are connected to the gas supply source 103 and the exhaust apparatus 105, respectively. The gas supply source 103 is capable of selecting which chamber the safety gas is supplied among: the first working chamber 131; the second working chamber 132; and the third working chamber 203, and also selecting which safety gas or air is supplied. The exhaust apparatus 105 is capable of selecting which chamber the atmosphere is exhausted among: the first working chamber 131; the second working chamber 132; and the third working chamber 203.

For the nano-fiber manufacturing apparatus 101 described above, maintenance work on the collecting unit 119 is performed as follows.

Figure 18:
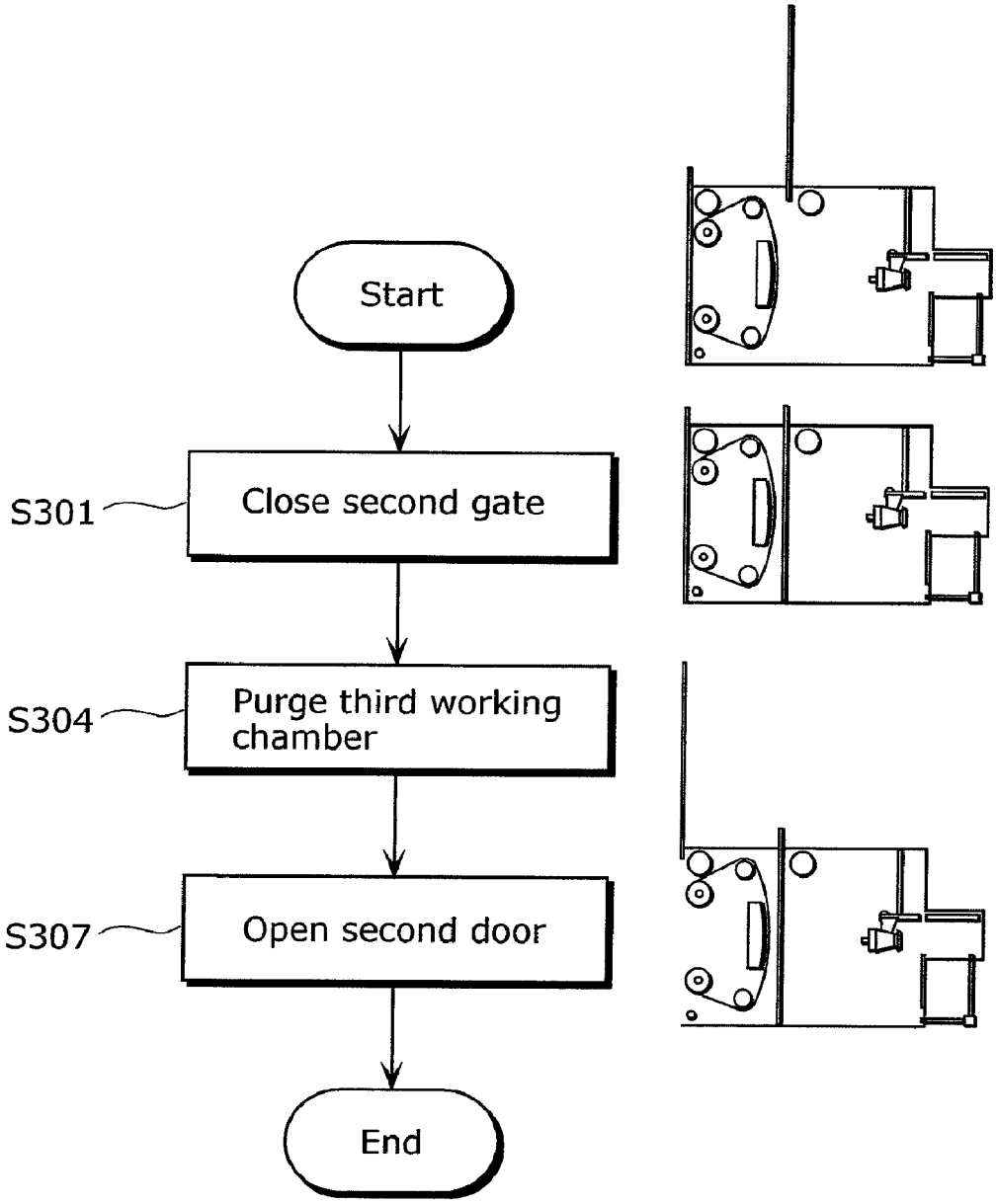
FIG. 18 is a flowchart showing the maintenance work process of the nano-fiber manufacturing apparatus, and a lateral view showing the state of the nano-fiber manufacturing apparatus corresponding to the respective work processes.

FIG. 18 is a flowchart showing the maintenance work process of the nano-fiber manufacturing apparatus, and a lateral view showing the state of the nano-fiber manufacturing apparatus corresponding to the respective work processes.

First, the second gate 206 is closed (S301). As a result, the first working chamber 131 and the third working chamber 203 are completely separated.

Next, the atmosphere in the third working chamber 203 is exhausted by the exhaust apparatus 105 while air is being introduced to the third working chamber 203, so that the atmosphere in the third working chamber 203 can be purged (S304: Purging step). When the atmosphere in the third working chamber 203 is fully replaced with air, the third working chamber 203 is opened by opening the second door 208 (S307: Opening step).

According to the above described method, a worker can easily access the collecting unit 119 while maintaining the manufacturing space 107 in the first working chamber 131 at a low oxygen condition, which allows maintenance work on the collecting unit 119 such as replacement of the sheet 160 to be performed easily. Since the third working chamber 203 can be opened widely by opening the second door 208, it is also possible to take the collecting unit 119 out of the third working chamber 203 easily.

Furthermore, according to this embodiment, maintenance work on the ejection unit 110 can be performed while maintaining the first working chamber 131 at a low oxygen condition; therefore, by performing maintenance work on the ejection unit 110 and the collecting unit 119 at the same time, it becomes possible to further shorten the time necessary for performing maintenance work.

Figure 19:
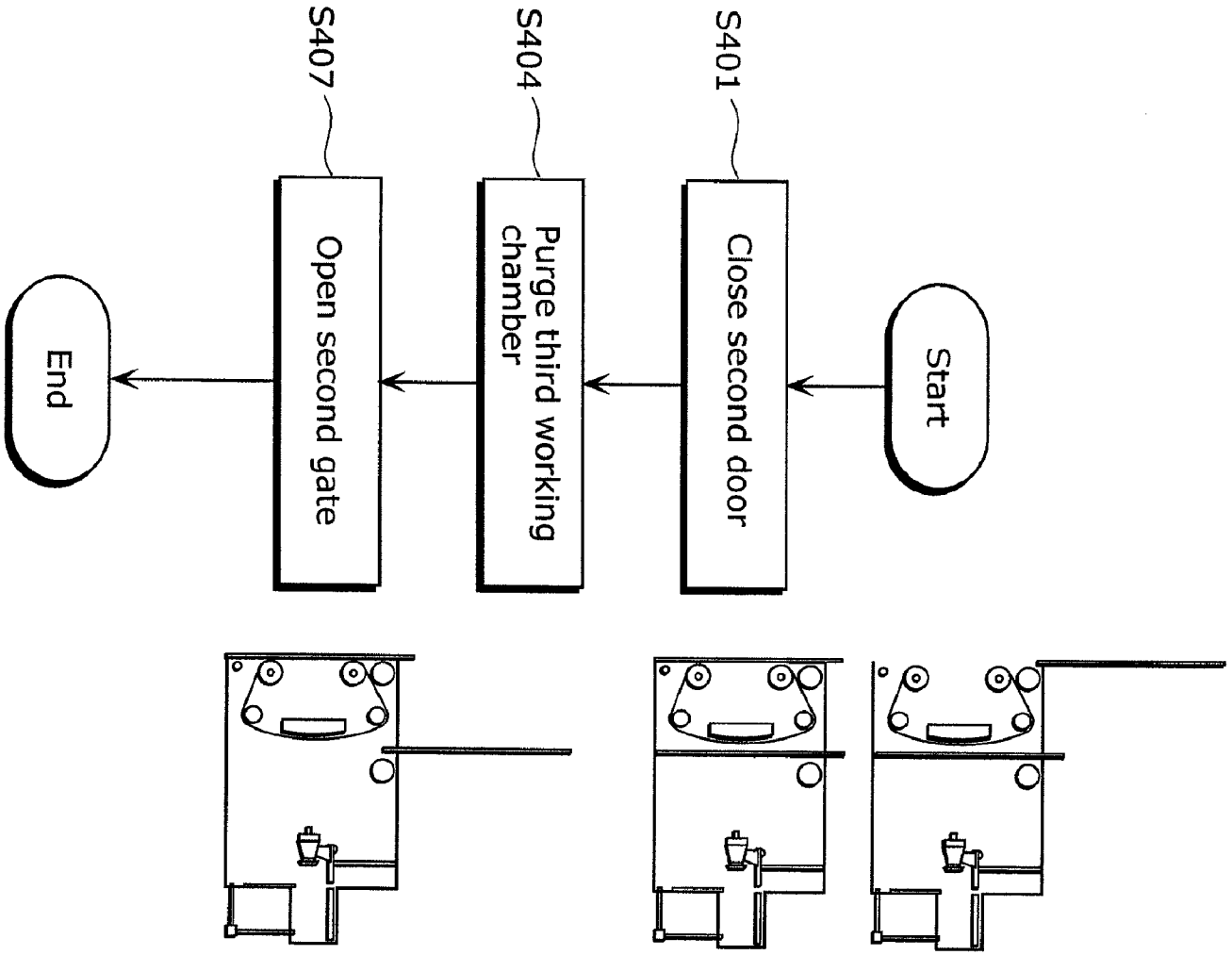
FIG. 19 is a flowchart showing a process of making to the nano-fiber manufacturing state after the maintenance work is completed.

FIG. 19 is a flowchart showing a process of making the nano-fiber manufacturing state after maintenance work is completed.

When maintenance work on the ejection unit 119 is completed, the second door 208 is closed (S401). Next, air in the third working chamber 203 is purged with safety gas (S404). This purging process prevents air from flowing rapidly from the third working chamber 203 to the first working chamber 131 and oxygen concentration in the first working chamber 131 from falling within an explosive range.

Next, the second gate 206 is opened (S407). As a result, the nano-fibers manufacturing state is made.

According to the above described method, it is possible to start manufacturing nano-fibers again while maintaining low oxygen condition in the first working chamber 131. As a result, the time necessary for making the maintenance state to nano-fibers manufacturing state can be shortened.

It should be noted that the ejection unit 110 described in the above embodiment is just an example, and the ejection unit 110 may be otherwise shaped or structured. For example, the ejection unit 110 in which the solution is ejected from a single nozzle, or an ejection unit having several nozzles which ejects the solution aligned may be used. Furthermore, the nozzle may be a two-fluid nozzle in which one of the nozzles ejects safety gas.

Furthermore, the shape of the collecting unit 119 is also not limited, and it may be configured in such a manner that the belt is rotated endlessly and the deposited nano-fibers are scraped off, or the nano-fibers are deposited directly on an electric conductor plate which serves as the collecting electrode 120 and the plates are replaced sequentially.

The electric potential relationship of the nano-fiber manufacturing apparatus 101 is also arbitrary. For example, the electric potential is not necessarily given to the collecting electrode 120 directly, but it is also applicable to place an auxiliary electrode near the collecting electrode 120, connect the collecting electrode 120 to ground, and give the electric potential to the auxiliary electrode in order to generate induced charge to the collecting electrode 120. As described above, the nano-fiber manufacturing apparatus 101 includes all aspects of relation of connection to the power source, ground condition, auxiliary electrode or the like. For this embodiment, a negative high voltage is applied to the collecting electrode and the ejection unit side is grounded, but the present invention is not limited to this, and the collecting electrode may be grounded and a high voltage may be applied to the ejection unit side. In other words, any structure can be used as long as the solution discharged from the ejection holes of the ejection unit is charged by an electric charge. Furthermore, another method may, for example, use a structure in which the ejection unit is connected to an electric charge generating unit such as a Van de Graaff generator so that the solution discharged from the ejection holes can be charged.

Industrial Applicability

The present invention can be applied to a nano-fiber manufacturing apparatus, an apparatus which spins using the manufactured nano-fibers, and an apparatus which manufactures nonwoven fabric using the manufactured nano-fibers.

The invention claimed is:

1. A nano-fiber manufacturing apparatus having an ejection unit that ejects solution which is a raw material liquid for a nano-fiber, to a manufacturing space in which the nano-fiber is manufactured by an electrostatic explosion of the solution, and a charging unit that charges the solution, said nano-fiber manufacturing apparatus comprising:

a gas supply source that supplies a safety gas to change an atmosphere of the manufacturing space, in which the solution is ejected, into a low oxygen atmosphere;

a partition that maintains the manufacturing space at a lower oxygen atmosphere than an atmosphere of a space outside of said partition, wherein a space inside of said partition includes the manufacturing space, and wherein the space inside of said partition is not air-tightly separated from the space outside of said partition;

a collecting unit configured to collect a manufactured nano-fiber;

a first working chamber having the manufacturing space inside and formed with said partition, said first working chamber being capable of keeping a safety gas inside;

a second working chamber connected to said first working chamber and formed with said partition, said second working chamber being capable of housing one of the ejection unit and said collecting unit;

a first gate being capable of opening and closing between said first working chamber and said second working chamber; and a first door being capable of opening and closing between said second working chamber and an outside of said second working chamber.

2. The nano-fiber manufacturing apparatus according to claim 1, further comprising:

a third working chamber connected to said first working chamber and formed with said partition, said third working chamber being capable of housing the other one of the ejection unit and said collecting unit which is not housed in said second working chamber;

a second gate being capable of opening and closing between said first working chamber and said third working chamber; and a second door being capable of opening and closing between said third working chamber and an outside of said third working chamber.

3. The nano-fiber manufacturing apparatus according to claim 1, further comprising:

a slide unit configured to allow the ejection unit to move between said first working chamber and said second working chamber.

4. The nano-fiber manufacturing apparatus according to claim 2, further comprising:

a slide unit configured to allow the ejection unit to move between said first working chamber and said second working chamber or between said first working chamber and said third working chamber.

* * * * *